US005137075A

United States Patent [19]

Gerding

[11] Patent Number: 5,137,075

[45] Date of Patent: Aug. 11, 1992

[54] CONTINUOUS CASTING APPARATUS AND METHOD

[75] Inventor: Charles C. Gerding, Brecksville, Ohio

[73] Assignee: LTV Steel Company, Inc., Cleveland, Ohio

[21] Appl. No.: 659,001

[22] Filed: Feb. 21, 1991

Related U.S. Application Data

[63] Continuation-in-part of Ser. No. 402,964, Sep. 5, 1989, abandoned, which is a continuation of Ser. No. 192,333, May 5, 1988, abandoned, which is a continuation-in-part of Ser. No. 108,217, Oct. 13, 1987, abandoned.

[51] Int. Cl.[5] ..... B22D 11/06

[52] U.S. Cl. ..... 164/263; 164/433; 164/434; 164/428; 164/431

[58] Field of Search ..... 164/434, 433, 482, 263, 164/480, 481, 428, 431, 432

[56] References Cited

U.S. PATENT DOCUMENTS

| | | |
|---|---|---|
| 2,206,930 | 7/1940 | Webster . |
| 3,295,174 | 1/1967 | Webber et al. . |
| 3,318,364 | 5/1967 | Bray et al. . |
| 3,318,367 | 5/1967 | Bray . |
| 3,326,271 | 1/1967 | Cofer . |
| 3,338,295 | 8/1967 | Scribner . |
| 3,351,126 | 11/1967 | Richards et al. . |
| 3,416,594 | 12/1968 | Gyongyos . |
| 3,452,808 | 7/1969 | Properzi . |
| 3,509,937 | 5/1970 | Radd . |
| 3,533,463 | 10/1970 | Hazelett . |
| 3,540,517 | 11/1970 | Wojcik . |
| 3,548,919 | 12/1970 | Gyongyos et al. . |
| 3,605,867 | 9/1971 | Gerding . |
| 3,627,025 | 12/1971 | Tromel et al. . |
| 3,628,597 | 12/1971 | Properzi . |
| 3,682,234 | 8/1972 | Vogel . |
| 3,710,846 | 1/1973 | Properzi . |
| 3,712,366 | 1/1973 | Gerding . |
| 3,756,304 | 9/1973 | Gerding . |
| 3,773,102 | 11/1973 | Gerding . |
| 3,785,428 | 1/1974 | Hazelett . |
| 3,811,491 | 5/1974 | Gerding . |
| 3,845,810 | 11/1974 | Gerding . |
| 3,895,673 | 7/1975 | Gerding et al. . |
| 4,723,590 | 2/1988 | Yamauchi et al. . |

FOREIGN PATENT DOCUMENTS 61-193750 8/1986 Japan .

OTHER PUBLICATIONS

"Recent Progress in a Unique Strip Casting Process" presented at the AIME 4th Advanced Technology Symposium on Near Net Shape Casting on May 10, 1987.

*Primary Examiner*—Kuang Y. Lin

*Attorney, Agent, or Firm*—Watts, Hoffmann, Fisher & Heinke Co.

[57] ABSTRACT

Apparatus for continuously casting strip material comprising a casting drum rotatable about a first axis, a pair of cheek members including portions slidably engageable with sides of the casting drum mounted for rotation about a second axis spaced from said first axis and a casting belt wrapped around a portion of the cheek members together defining a converging casting arc. The cheek members include peripheral surfaces engageable by marginal edges of the casting belt which maintain a variable casting gap between a casting surface on the belt and a casting surface on the drum. The eccentric mounting of the cheek members with respect to the casting drum cause the spacing between the belt and the drum to decrease as the end of the casting arc is reached. The cheek members each include tapered side surfaces which together with the casting drum define ear receiving recesses that increase in a radial direction as the end of the casting arc is approached. The ear receiving recesses thus defined permit a liquid metal pool to exist which is of considerably greater depth than the height of the ears cast by the machine.

39 Claims, 15 Drawing Sheets

196
176
194
176
132
178
250
250
22a'
134
130
134
22b'
174
174
256
192
264
262
188
266
262
264
218
219
10'
214
216
48'
48'
270
264
262
262
270
268
46'
46'
268
266
266
50'
50'
256
44'
20'
44'
256
172
190
192
116
120
120
120
120
172
1009
1009
164

CONTINUOUS CASTING APPARATUS AND METHOD

This application is a continuation-in-part of Ser. No. 07/402,964, filed on Sep. 5, 1989, now abandoned. Ser. No. 07/402,964 was a continuation of Ser. No. 07/192,333, filed May 5, 1988, now abandoned. Ser. No. 07/192,333 was a continuation-in-part of 07/108,217, filed Oct. 13, 1987, now abandoned.

TECHNICAL FIELD

The present invention relates generally to continuous casting processes and in particular to a method and apparatus for continuously casting relatively thin strip, both outer surfaces of which, have been cast against a chill surface. The apparatus of the invention utilizes a rotatable yoke to facilitate maintenance and repair. Moreover, an extension mechanism is are provided for automatic adjustment of the cast length in the continuous cast process without modification of strip thickness.

BACKGROUND ART

Various apparatus and methods for continuously casting two sided metal strip utilizing opposed moving chilled surfaces, are known or have been suggested in the past. In such instances, two confronting, moving surfaces are employed. In a "Bessemer" machine (U.S. Pat. No. 49053), a pair of confronting but spaced apart rolls define the moving surfaces. The axes of the rolls are typically parallel and horizontally positioned and the roll surfaces form a nip where the rolls are closest to each other which defines the casting thickness. Molten metal contained between upper portions of the roll and side dams above the nip, freezes on the chilled periphery of the rolls.

In theory, a continuous solidified strip of metal is discharged vertically downward from the nip of the rolls. It has been found, however, that the process of using rolls and side dams for containing the pool can be very difficult to control. In particular, in the fixed gap mode of operation, (i.e., where the roll center to center distance is fixed) if sufficient contact time is not provided between the metal being solidified and the chilled surfaces, "break out" can occur in which molten metal in the center of the strip ruptures through the hardened outer layer. If the contact time is excessive, the rolls may jam because the total thickness of material solidified on each of the rolls is greater than the nip dimension. In addition, freezing of material on the side dams causes jams and/or other process problems.

The Bessemer-type machine is considered a "converging gap" type machine (as opposed to a "constant gap" machine) since the pool of molten metal carried above the confronting rolls has a transverse dimension that decreases as the nip is approached. In a Bessemer machine, the contact time is determined by the dimension of the rolls and their speed and the pool depth.

In an effort to overcome some of the difficulties of the Bessemer machine, an "inside-the-ring" (ITR) type machine has been suggested in the past in which a large rotating vertical ring contains a pool of molten metal at the bottom. As the ring rotates, molten metal freezes on an inside surface to form a strip of material that is discharged spirally from the ring. The ring normally has cooled metal side dams which contain the pool of molten metal. To make the process two-sided, a roll or drum is rotatable with the ring and defines a gap or nip between itself and the inside of the ring. An example of such an apparatus is shown and described in U.S. Pat. No. 3,773,102. In this type of machine, "ear loss" that is, the material which is cast against the side dams and must later be trimmed becomes a concern. It should be appreciated that molten metal freezes on any chilled surface and in the case of an "ITR" machine, material can be expected to solidify on the side dams and the sides of the drum. Generally the "ears" can be cut from the strip and re-used as scrap metal.

Constant gap strip casting machines (such as the Hazelett twin belt machine which is well known in the industry) do not in general have an ear problem in that they cast strip of a rectangular rather than a channel-shaped cross section. In the typical constant gap machine liquid metal fills the gap at the input end of the machine and as the metal moves down the machine and freezing progresses from the walls, the central core of liquid metal gradually decreases from the full thickness of the constant gap to zero. Such machines use constant thickness blocking means to keep the liquid from running out at the ends; such blocks may run along with the moving casting surfaces.

Generally the most serious problem encountered with constant gap machines is providing a means for introducing the molten metal into the casting gap. Since in all constant gap machines, a gap corresponding to the final casting thickness is defined between the two casting surfaces, for small thickness strip material, very little access is provided for introducing molten metal.

Several methods have been used for preventing the metal from running out at the ends in converging gap machines. Although attempts have been made to contain the metal with insulators which are supposed to operate at a high temperature so that no metal is cast against them, the general method of interest here involves containing the converging gap with casting surfaces. Two such methods are exemplified by the inside-the-ring machine (U.S. Pat. No. 3,773,102) and the Schloemann drum-belt machine (U.S. Pat. No. 3,627,025). In both of these a pool of metal is restrained at the sides by metal (or coated metal) side dams which preferably move contiguously with the ring or belt of the machine. In the Schloemann machines, the ears are straight up (i.e., at right angles to the strip). In the ITR machine the ears project upward at some greater angle than 90° to the strip. However, in both of these machines, a gap is provided between the end of the drum and the ring side dam, this gap must be at least wide enough to accommodate the thickness of metal that is frozen on the drum ends and on the side dams. This gap is typically open ended at the top.

Another machine utilizing cast in ears as an edge restraint is seen in U.S. Pat. No. 2,450,428 (Hazelett) and features a drum with rounded ends proximate to and forming a nip with either the outside or the inside of a large ring that is fitted with side dams which cast ears of arcuate shape. Here the ears are arcuate and taper to zero thickness at the top. It is noted that the side dams of the ring each touch the adjacent rounded end of the drum at essentially only one point. This point is a point of tangency of a circle on the drum and another circle on the ring.

In all of the converging gap designs cited above, the depth of the pool is at most the height of the side dam of the ring, and in the case of the Hazelett roll outside the ring machine it is less.

Another important consideration is the productivity of a given machine. As indicated above, the speed at which a machine can produce a solidified strip is a function of "contact length" of the molten metal with the chilled surface or surfaces. It is well known from actual experiments that the thickness of casting that builds up against a chill surface varies at least approximately according to the relation $x = K\sqrt{t} - B$ where x = inches of casting thickness t = seconds of immersion time K and B are constants depending on the parameters of the system (materials, temperatures, etc.)

It follows that if a given thickness is to be cast, a certain immersion time is required to cast it. This time may be realized for example by either a short immersion length in a slowly moving machine or a long immersion length in a fast moving machine. Obviously machines with long immersion lengths are faster and more productive, and an otherwise small machine with a long immersion length is to be preferred from a first cost and a productivity standpoint.

For converging gap machines with appreciable contact time, the formation of ears becomes a serious problem. It should be appreciated that the increased contact time which allows a greater productivity of strip also increases the time during which the ears can be formed and hence greater ear thickness may result. In all inside the ring or belt machines of converging gap design where an open pool is employed (e.g. the ITR or the Schloemann machines), the ear height is at least as great as the depth of the open pool.

DISCLOSURE OF THE INVENTION

The present invention provides a new and improved method and apparatus for continuously casting metal strip in which high productivity can be realized with reduced ear loss. In the preferred and illustrated embodiment, a machine having the advantages of extended contact time, converging gap, and metal rather than refractory side dams etc. is provided.

According to the invention, two converging casting surfaces are defined into which molten casting material is introduced. Edge constraints usually termed "side dams" contain the casting material between the converging casting surfaces. According to the invention, the edge constraints are configured to accommodate the growth of "ears" along the edge of the metal strip as it moves through the casting arc or casting path. As is known, the size of the ears increase as the cast strip approaches the end of the casting path. With the present invention, the side dams are configured to accommodate the increasing size of the ears so that interference, or so called "ear crushing" does not occur at the exit nip or end gap defined by the casting surfaces.

In one embodiment of the invention, a belt and drum together define non-concentric, circular casting surfaces and in effect form a converging gap. Side dams in association with the belt move about an axis of rotation that is different from the axis of rotation of the drum. In addition, the side dams or cheeks define a recess for receiving ear material as it is formed. The recess defined between the cheek and a side of the drum increases in the radial direction as the end of the casting arc is approached.

The side of the drum is vertical and at right angles to the cylindrical drum surface. During one mode of operation, material is cast on the side of the drum as well as the cheek. The expanding recess provides a relief for this material so that jamming does not occur at the point where the belt and drum are closest.

According to a feature of this embodiment, the cheeks are defined as the inner surfaces of a pair of rings rotatable about an axis that is off-set from an axis of rotation of the drum. A recess is formed on an inside radial face of each ring member such that the recess, narrowing in the direction of decreasing radius, is defined between confronting portions of the drum (i.e., the vertical sides of the drum) and the cheek ring. Each ring also defines a circumferential surface against which an endless belt rides for a portion of its travel. A converging casting gap is thus defined between a casting surface on the drum surface and an inside belt surface, the variable distance at which the belt is spaced from the drum being determined by the ring members and their eccentricity with the drum. In the preferred and illustrated embodiment, the radius of rotation for the belt when in contact with the cheek members is selected to be larger than the radius of the drum, the difference in the radii being equal to the eccentricity between the rings with drum plus the thickness of strip being cast. With the disclosed construction, a converging gap machine can be realized in which extensive contact length is provided while controlling or reducing ear loss.

According to another feature of the invention, the cheek members are biased by springs or other forces towards a side surface of the drum to inhibit leakage of molten material between the cheek and the side of the drum. In the preferred embodiment, a frame member mounts a bearing arrangement which in effect defines a fixed, non-rotatable bearing race that captures ball bearings which in turn rollingly support the cheek member. The cheek member includes surfaces defining a cooperating, bearing race. In the preferred and illustrated embodiment, driving arrangements are provided for driving the drum at a predetermined speed as well as driving the belt and ring members. Preferably, the ring members and belt are driven at constant speed so that the belt and cheeks move in unison. To compensate for the greater distance that must be traveled by the belt since its radius of movement is larger than the drum, the belt and cheeks may be driven at a somewhat greater surface speed than the drum for reasons that are described in U.S. Pat. No. 3,811,491, which is hereby incorporated by reference.

In another embodiment of the invention, a drum rotating within a rotating ring define non-concentric, circular casting surfaces which together form a converging gap. This is often termed an "in-the-ring" or ITR type machine. In this embodiment, an oscillating cheek, defining a tapered recess, is used on both sides of the machine to constrain the molten pool in the casting arc. As in the first embodiment, an expanding, ear receiving recess is defined between a cheek and its associated side of the drum. In operation, material is cast on the side of the drum as well as the associated cheek. The recess expands (in the radial direction) as the end of the casting arc is approached and provides a relief for the cheek material so jamming does not occur at the point where the drum and ring are closest.

In another embodiment, the principles of the invention are applied to a Bessemer type machine in which the casting surfaces are defined by two spaced apart rolls. In this embodiment, the edge constraints (for containing the molten pool) are defined by a pair of belts disposed on each side of the rolls and which in effect, define an expanding recess associated with each roll. It should be noted that in the above two described embodiments, the cast strip was substantially U-shaped in cross section with the ears defining the legs of the U-shaped section. In the Bessemer type embodiment, the cast strip resembles an I-Beam in cross section since an expanding recess is defined for each drum side and there are four sides. In this embodiment, the belts are substantially vertical oriented and travel in substantial synchronization with the strip material as it is being cast. The belt pairs are arranged at an angle with respect to their associated roll sides and thereby define tapered recesses. The juncture of the belts define the center line of the cast strip.

In still another embodiment, the principle of the invention is applied to a converging belt type machine. In this embodiment, ear receiving recesses are defined by a belt of cheek blocks that travel along the edges of the belts. In the preferred construction, one belt is vertically oriented whereas the other belt rides along a curved guide in a confronting relationship with the first belt to define the converging gap. The belt of blocks abuttably contacts the surface of the vertical belt and the side of the curved guide. In effect, the belt of blocks (when in contact with the casting belts) defines an expanding recess between the inside of the confronting blocks and the side of the casting belt guide that expands as the end of the casting arc is approached. In this embodiment of the invention, the resulting metal strip is substantially U-shaped in cross section with the legs of the "U" defined by tapered ears.

In still another preferred embodiment, the invention includes a casting length adjustment feature. This feature provides greater control of fundamental casting parameters, such as casting length, while holding cast thickness and speed constant. Casting length adjustment is used, as required, to increase cast production. One application is to increase the casting length to compensate for decreasing hot metal input temperatures. Moreover, casting length adjustment promotes constant input conditions of cast metal from the strip caster into other processes, such as rolling mills and the like.

The casting length adjustment feature includes an alternative yoke member rotatably supported about a third axis. Positive stop bolts securely fasten the yoke to the cross members to prevent unwanted yoke pivot. Belt replacement and repair is facilitated by unsecuring and rotating the yoke away from the casting belt.

The yoke rotatably supports the cheeks. As previously described, the cheeks provide sufficient space for the formation of ears during the casting process. A biasing means is mounted on top of one end of the yoke to bias the drum against the casting belt.

A drum extension mechanism is rotatably mounted on the yoke. The extension mechanism includes interlocking sleeves which pivot about a fourth axis defined by the cross member. The casting drum is rotatably supported between the cheeks by one end of the extension mechanism. At the other end, a set of bevelled miter gears, driven by an external power source can be rotated to expand and contract the interlocking sleeves. Additionally, as the cast length is adjusted, the drive mechanism automatically adjusts itself through the use of articulated gears and sprockets to maintain a continuous direct drive. Adjustment of the cast arc length can be used to control the thickness of the cast strip and in particular to control it to a substantially constant value under changing casting conditions.

Additional features of the invention will become apparent and a fuller understanding obtained by reading the following detailed description made in connection with the accompanying drawings.

BEST MODE FOR CARRYING OUT THE INVENTION

Figure 1:
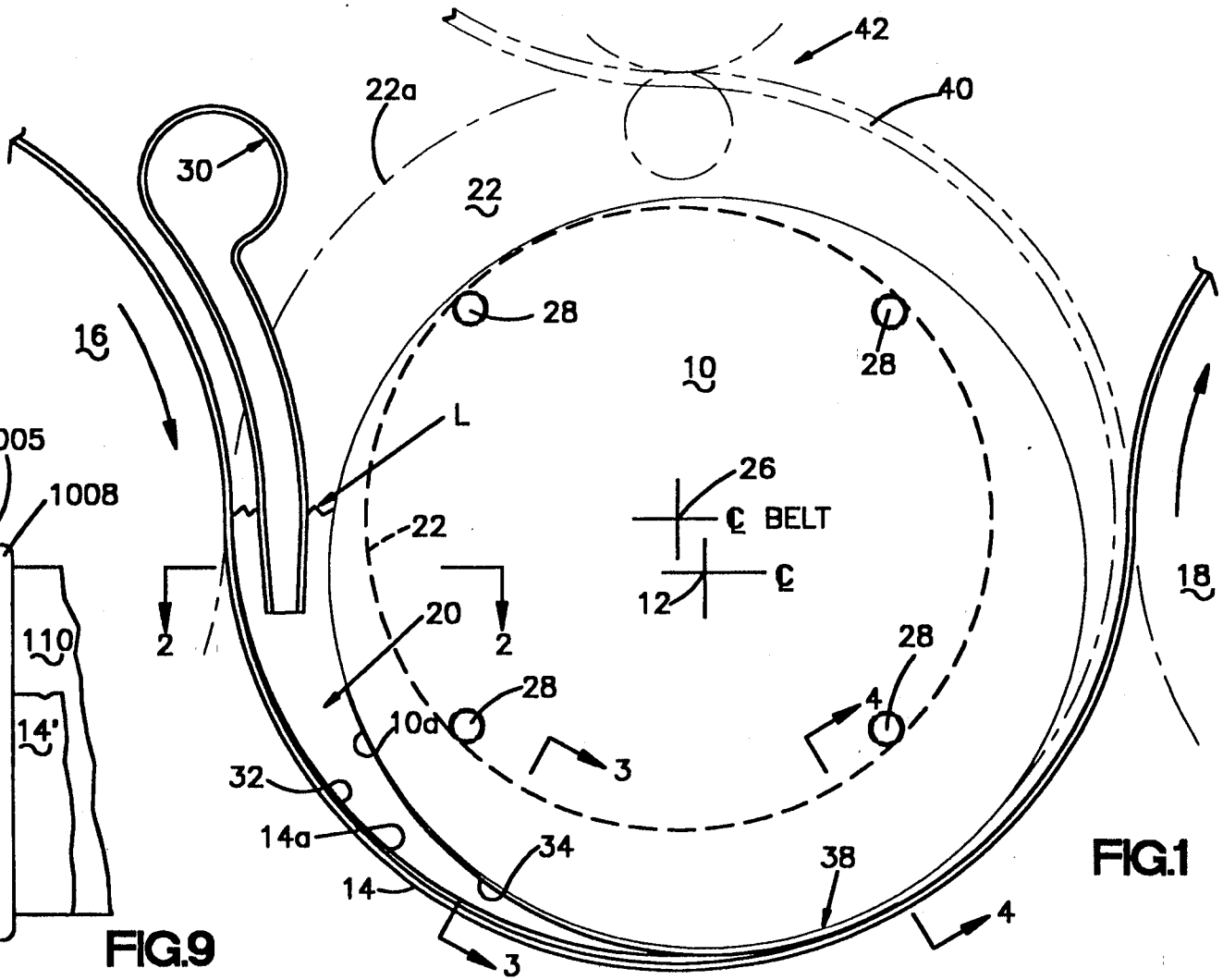
FIG. 1 is a schematic representation of an apparatus embodying the present invention.

FIG. 1 schematically illustrates an apparatus constructed in accordance with a preferred embodiment of the invention. The apparatus includes a casting drum 10 rotatable about an axis 12. A belt 14 supported between rolls 16, 18 moves below the drum 10 in a spaced relationship, the distance between a drum surface 10*a* and an inner belt surface 14*a* decreasing such that a converging gap, indicated generally by the reference character 20 is defined.

Rotatable side cheeks 22 (only one cheek is shown in FIG. 1) are disposed on either side of the drum 10 and each cheek defines a peripheral, circumferential surface 22*a* against which the belt 14 is supported as the belt moves below the drum 10. Each cheek member is preferably annular or ring-like in construction. An axis 26 of rotation for the cheek members 22 is spaced from the axis of rotation 12 of the drum. The radial distance between the peripheral surface 22*a* and the axis of rotation 26 is larger than the radius of the casting surface 10*a* of the drum 10. The cheeks 22 are supported for rotation by bearings 28, shown schematically.

Molten metal is injected or delivered into the gap 20 by a nozzle 30 so as to fill the pool to the level L. In operation, as the drum 10 and cheeks 22 rotate in the counterclockwise rotation (as viewed in FIG. 1) molten metal freezes on the belt surface 14*a* and drum surface 10*a* since these surfaces are normally chilled. These partial strips are indicated by the reference characters 32, 34. As expected, the thickness of the strips gradually increase as the contact time increases, i.e., as the chilled surfaces move towards the end of the casting arc. At or near the end of the casting arc indicated by the reference character 38, the individually cast strip portions 32, 34 fuse together and exit the casting arc as a unified strip of material indicated generally by the reference character 40. The cast strip 40 then proceeds through an additional arc of travel maintaining contact with the belt until the belt is stripped from the casting when it changes curvature by being payed onto roll 18. To ensure this action, a very slight overspeeding of the drum may be employed.

The apparatus shown in FIG. 1 may include a cutter assembly indicated generally by the reference character 42 which is operative to trim the "ears" from either side of the strip as the strip exits the machine. The cutter is preferably positioned so that the ears are cut off before the casting is bent to a different radius of curvature from that shown at 40.

Figure 2:
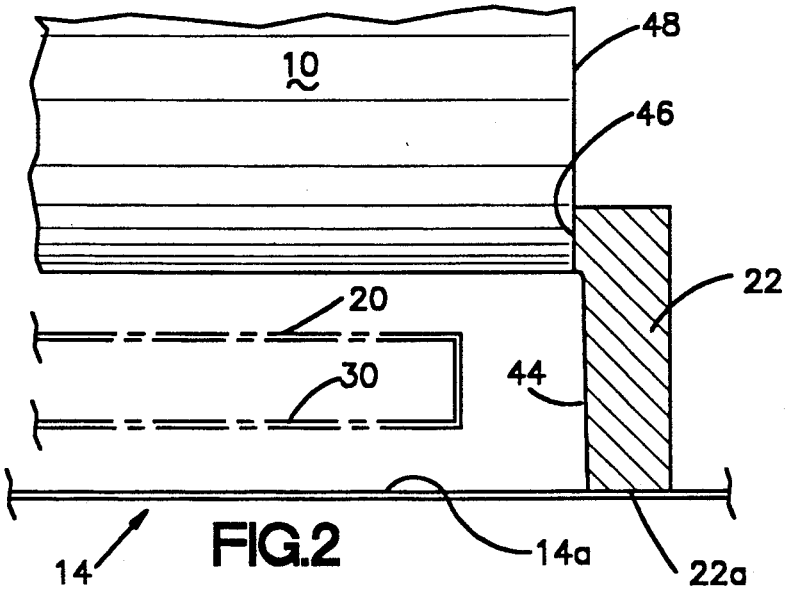
FIG. 2 is a fragmentary, sectional view of the apparatus shown in FIG. 1 as seen from the plane indicated by the line 2—2 in FIG. 1.
Figure 3:
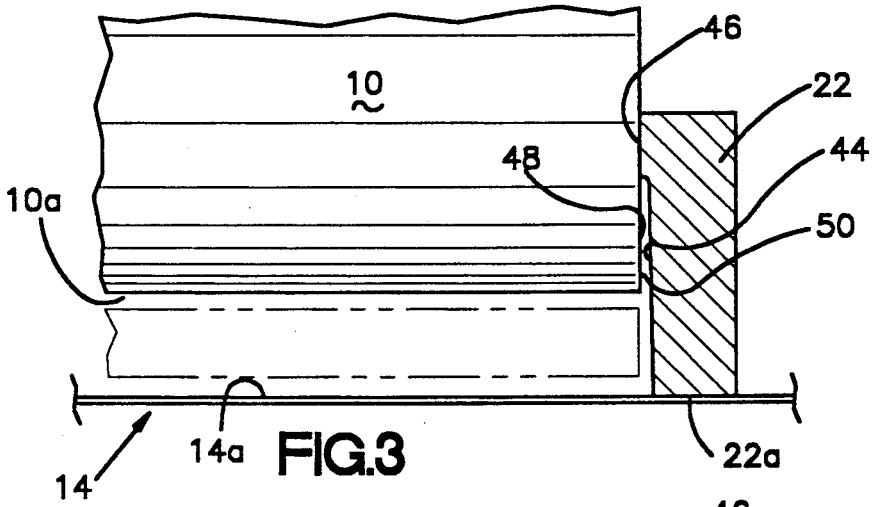
FIG. 3 is a fragmentary, sectional view as seen from the plane indicated by the line 3—3 in FIG. 1.
Figure 4:
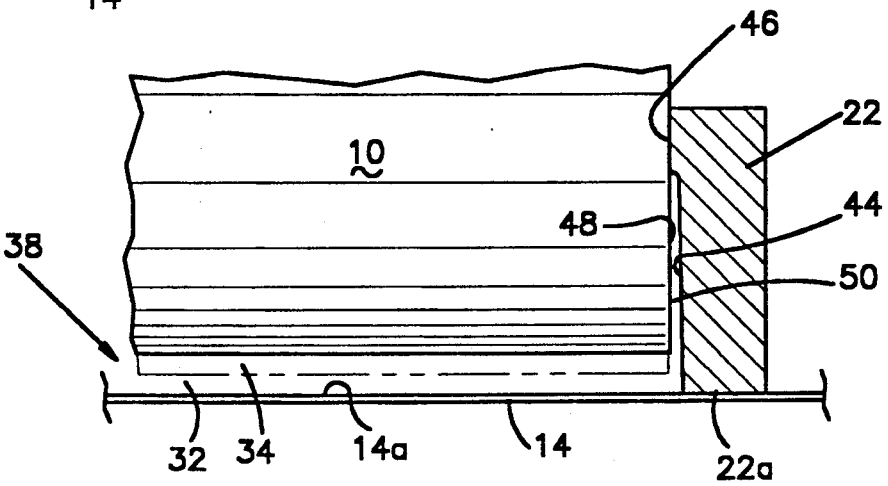
FIG. 4 is a fragmentary, sectional view as seen from the plane indicated by the line 4—4 in FIG. 1.

Referring also to FIGS. 2–4, the construction of the cheek members 22 and their cooperation with the drum 10 will now be explained. FIGS. 2–4 represent sectional views of the apparatus as one proceeds along the casting arc. In FIG. 2, the distance between the belt 14 and periphery of the drum 10 is relatively large and facilitates the introduction of molten metal by the nozzle 30. As seen in these Figures, each cheek member 22 defines an inner tapered surface 44 such that in section, the transverse dimension of the cheek member narrows with a radially increasing distance. Each cheek member also defines a short, radial abutting surface 46 which slidingly and sealingly engages a side of the drum 48 in order to define a closed ear cavity or recess 50 when the cheeks move through the casting arc 20. The width of the cavity 50 between the cheek and the drum as shown in FIG. 4 increases with increasing radial distance.

The ring cheek construction as described represents a novel way of edge containment in a casting machine in that the ear cavity is closed (and slidably sealed) at the top for a considerable length, thus permitting a liquid metal pool to exist which is of considerably greater depth than the height of the ears cast by the machine. The height of the ears is essentially the width of the open pool surface into which liquid metal is poured and (insofar as the dimensions and design of the metal input means, e.g., nozzle, can be minimized) this dimension and hence the ear loss can be minimized. However, even with this width so minimized, this design affords an adequate width of the pool many times the thickness dimension of the strip being cast.

It is recognized that the shape of the recess in the cheek may be varied for best results—generally to provide a just-sufficient space for the ear during its formation without allowing the ear thickness to encroach on the space between the curved face of the drum and the belt while still keeping to near zero the amount of liquid that flows around to the flat side of the drum. Obviously some amount of shearing and/or tearing of just-solidified ear material may occur. Since the ears are removed and remelted, their quality does not matter.

As described above, the centers of rotation for the cheek members and drum are different. They are selected such that, for the portion of rotation through the casting arc, each cheek member moves radially inwardly with respect to the drum. This relationship can be seen in FIGS. 3 and 4 where it should be noted that the distance between the drum surface 10*a* and the inner belt surface 14*a* decreases substantially. As seen in FIGS. 3 and 4, since the cheek member 22 defines a tapering surface 44, a gradually increasing recess 50 is defined between the drum and the cheek member. The recess 50 receives just cast ear material as the strip approaches the nip 38.

It must be remembered that material will freeze on any chilled, uninsulated, or unheated surface. Each cheek member 22 and the sides 48 of the drum each constitute a chilled surface. Even though these surfaces may, by design, be coated with insulating material to mollify the rate of freezing that will occur thereon, it is recognized that some freezing will certainly occur. As a result, during the casting process, material will freeze on the drum surface 10*a*, belt surface 14*a*, the portion of the drum side 48 that confronts the surface 44 on the cheek and the cheek surface 44. As the strip is formed, the thickness will increase as it approaches the casting nip 38. This is illustrated by the strips 32, 34 shown in FIG. 4. If the cavity 50 is sufficiently wide in the axial direction, material of comparable thickness will also form on the drum surface 48 and the cheek surface 44. Because of the tapering recess 50 that has an increasing transverse dimension, this increasing ear thickness is accommodated. Hence, with the present invention, jamming does not occur due to ear formation.

In addition, under carefully controlled conditions, and in general for a lower speed than for operating under the conditions cited above, the ear formed on the cheek surface 44 can mask the portion of the drum side 48 enclosed by the cheek member and, in effect, prevent the freezing of material on the side of the drum. Under these optimum conditions, substantially reduced ear loss can be obtained.

However, if the operating speed chosen for a machine with a given ear cavity is too low, the machine will jam because more material will freeze on the cheek surfaces than the cavity between the cheek and the flat side of the drum can accommodate: the too-thick material then grows out into the space between the curved surface of the drum and the belt where it is squashed and tends to lift the drum.

It is seen that although a preferred embodiment features a drum that is spring or weight loaded against the belt (floating drum), that an optional method of operation is to fix the drum (constant nip dimension).

Turning now to FIGS. 5–8, a machine embodying the present invention is detailed. Components in FIGS. 5–8 which have similar counterparts in FIG. 1–4 will be designated with the same reference character followed by an apostrophe (').

Figure 5:
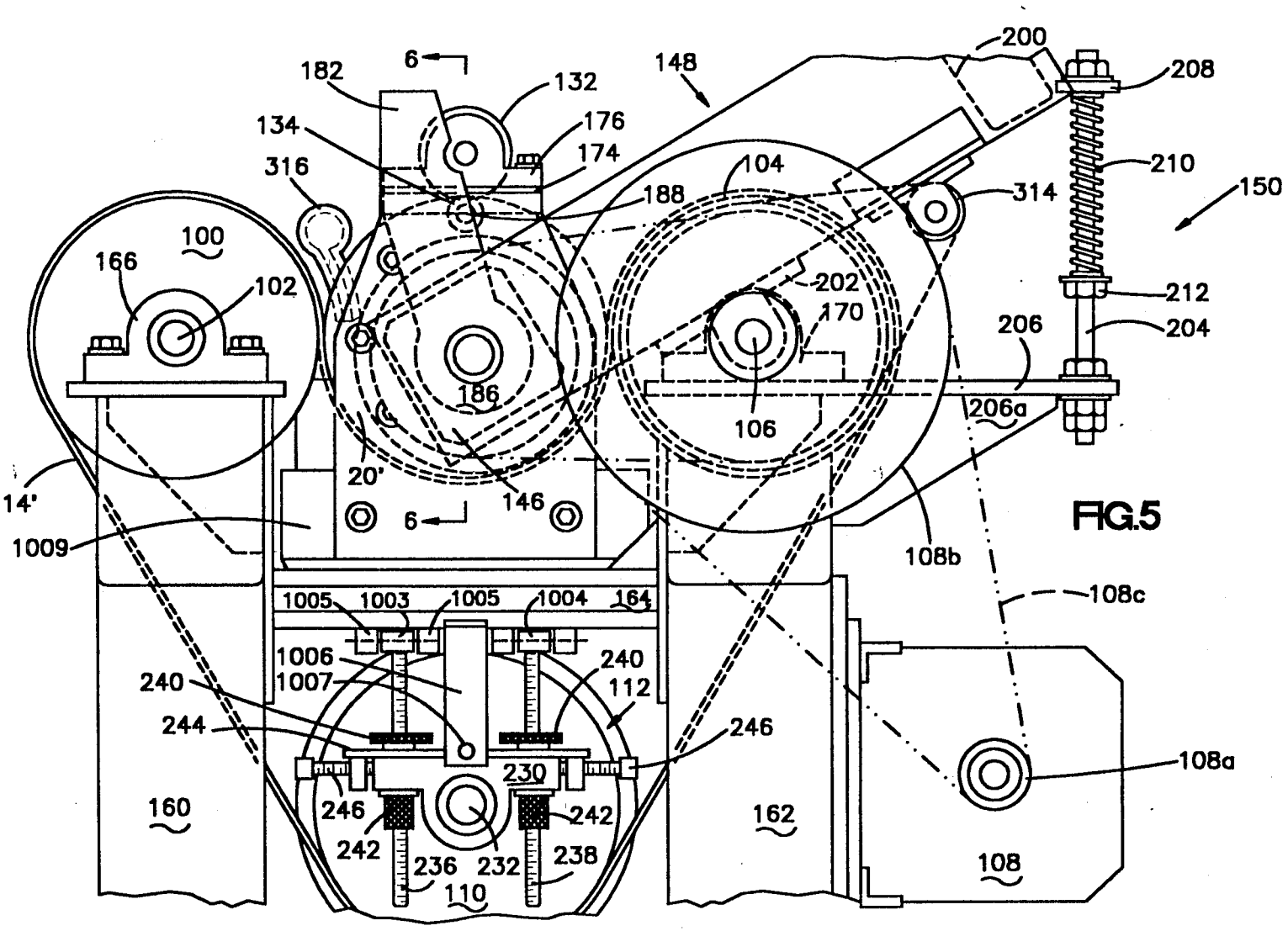
FIG. 5 is a side elevational view of a casting machine embodying the present invention.
Figure 7:
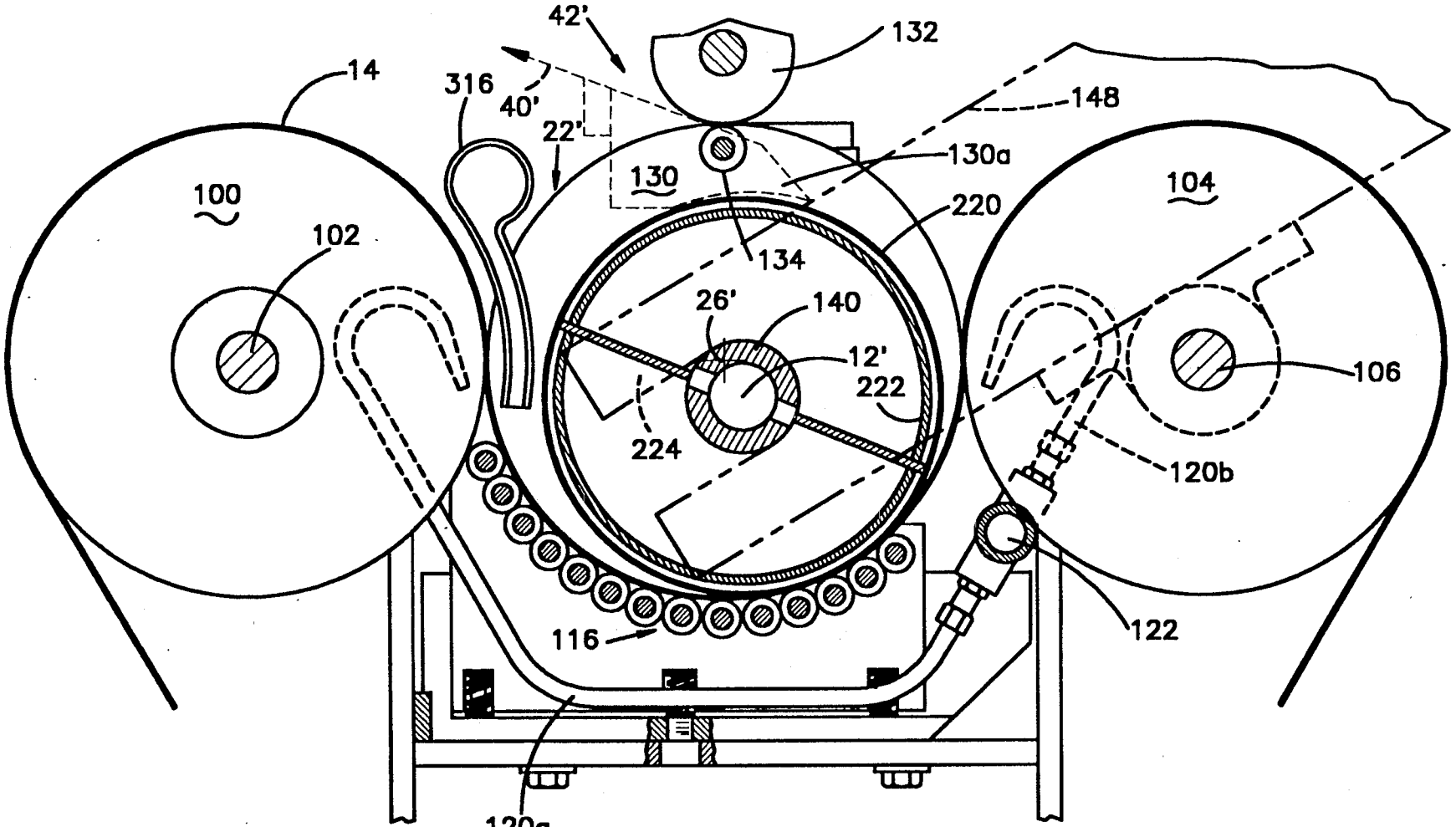
FIG. 7 is a fragmentary view of the machine shown in FIG. 5 with parts omitted for clarity; and, FIG. 8 is a top elevational view of the machine shown in FIG. 5.

Referring first to FIGS. 5 and 7, the belt supporting apparatus and casting drum are best illustrated. A first belt support roll 100 is supported on a tail shaft 102. The casting belt 14' is reeved under the casting drum 10' and cheek assembly, and is reeved around a drive roll 104 supported for rotation by a head shaft 300. The drive roll 104 is power driven by a motor 108 (shown in FIG. 5) via drive sprocket 108*a* driving sprocket 108*b* on shaft 300 through chain 108*c* and through a reversing and differential assembly 109 (shown in FIG. 8 but not shown in FIG. 5 since it is hidden from view by sprocket 108*b*). The lower section of the belt 14' is supported by an idler roll 110 (shown in FIGS. 5 and 9) which includes an adjustment mechanism indicated generally by the reference character 112 for adjusting the tension and/or tracking of the belt 14'.

As seen best in FIG. 7, a plurality of support roll assemblies defining an upwardly spring loaded roller apron 116 defines a circular path below the casting drum 10' and provides support for the belt 14' in the casting arc. Water conduits 120*a*, 120*b* are provided and include a water inlet and header 122 for feeding cooling water onto the belt between the fins 226 of the finned belt rolls 100, 104, respectively.

Figure 6:
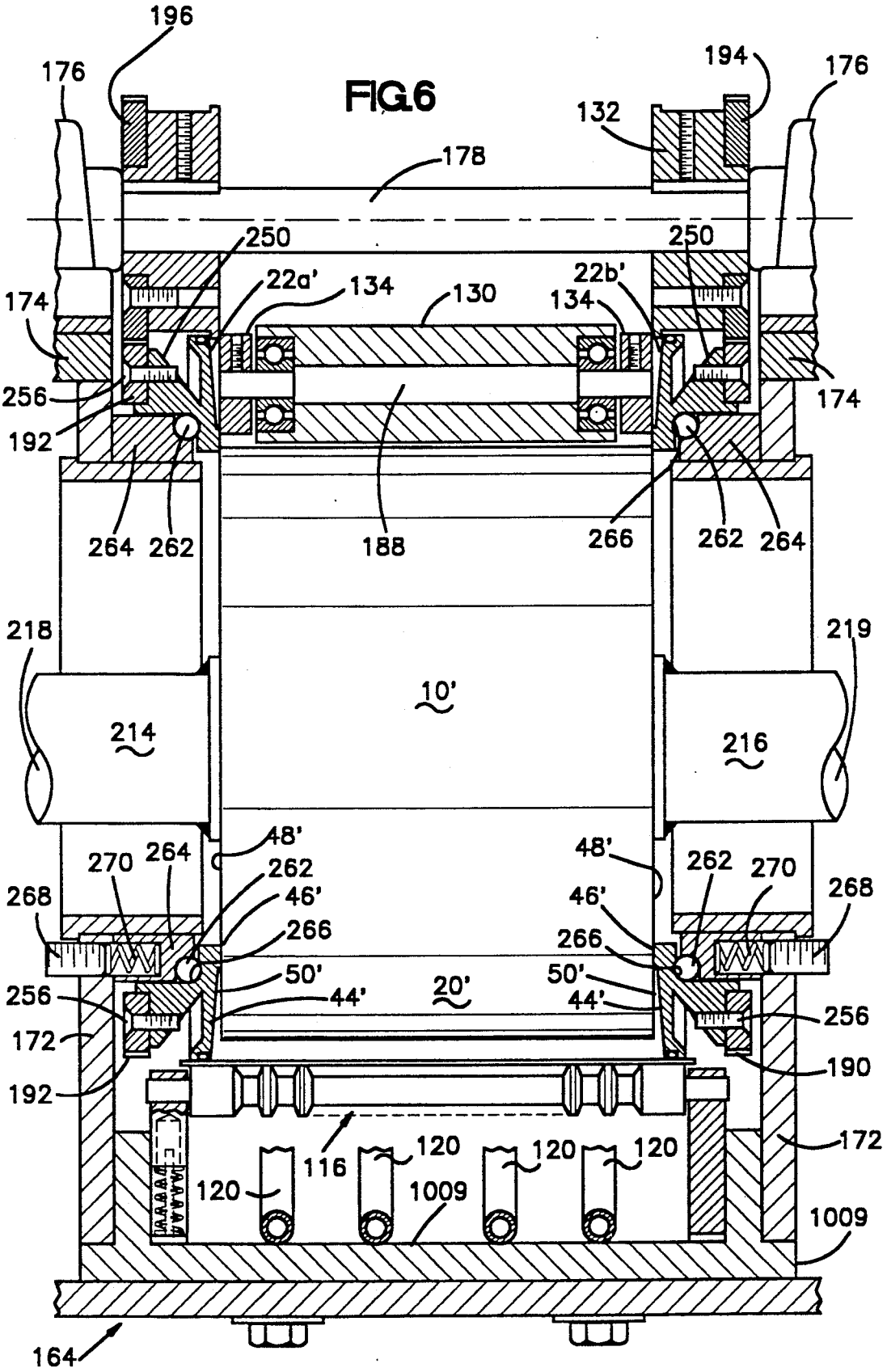
FIG. 6 is a fragmentary vertical sectional view of the machine as seen from the plane indicated by the line 6—6 in FIG. 5.

A doctor blade 130 is positioned above the casting drum 10' and is located between a pair of cheek members 22', 22*a* ', 22*b* ' (shown best in FIG. 6). The doctor blade includes a leading, angled blade portion 130*a* that guides any wayward leading edge of the strip leaving the casting drum 10' into the cutter assembly 42'. The cutter assembly 42' includes a pair of upper and lower cutters 132, 134 at either edge of the strip so that ears formed on the strip can be trimmed as the strip leaves the machine.

It will be evident to those skilled in the art that the trimming of the ears however done is most desirably done before the strip is unbent from the radius at which it is cast. The inner edge (the smaller radius) of the ears so trimmed are preferably continuously bent up by a scraper arrangement (not shown) so that the trimmed ear exits the machine in a continuous spiral helix (in a manner completely analogous to the spiral helix form of continuous chip generated by a lathe tool in turning down a shaft). These continuous spirals may be broken up by appropriate means.

As seen in FIG. 7, the axis of rotation for the cheek members 22' is indicated by the reference character 140. The axis of rotation of the drum 10' is indicated by the reference character 12' and is defined by a movable support system including bearing assemblies 146 (only one is shown in FIG. 5) which form part of a yoke assembly 148. The yoke assembly 148 is movable and is used to adjust the desired casting thickness or alternately the drum pressure should a floating drum operation be used. In the latter case, the yoke assembly 148 may be spring loaded to adjust this pressure or to allow the drum and belt to separate should the strip thickness increase unexpectedly. In the disclosed embodiment, the illustrated yoke assembly 148 is spring loaded by an adjustable spring assembly 150 to be described further on.

Figure 8:
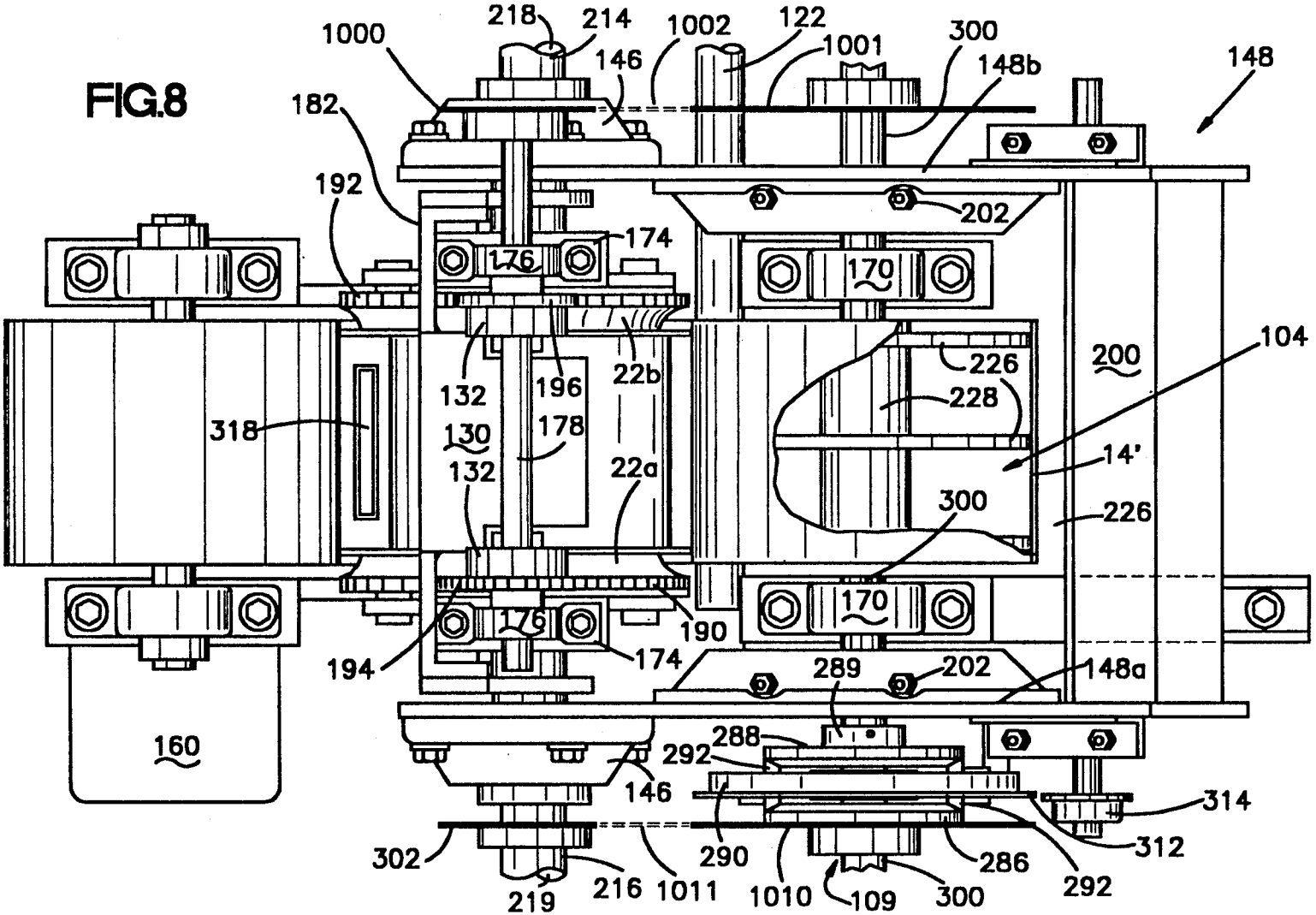

Referring again to FIGS. 5 and 6, the supporting frame for the various rolls and casting drum is detailed. In particular, the frame comprises a pair of upstanding supports 160, 162 which extend upwardly from the floor or other rigid base. Transversely extending cross members 164 (only one cross member is shown) extend between and are supported by the upstanding supports 160, 162. A pair of pillow blocks 166 are rigidly fixed at the upper end of the frame support 160 and to a cantilevered bracket therefrom and rotatably support the tail shaft 102. Similarly, and as best shown in FIG. 8, the head shaft 300 is rotatably supported by a pair of pillow blocks 170 bolted to the upper ends of the upstanding support 162 and to a cantilevered bracket therefrom. Supports 160, 162 occur only on the near side of the belt in FIG. 5 and the frame structure for supporting far side pillow blocks 166, 170 is cantilevered out (away from the viewer) from these supports so that belt replacement from the far side is facilitated.

The cheek support assemblies and associated components are supported by a pair of plates 172 disposed on either side of the casting drum 10' and bolted to the cross piece 1009. The plates 172 terminate, at their tops in respective mounting pads 174 to which pillow blocks 176 are bolted. The pillow blocks 176 rotatably support a shaft 178 to which the upper cutters 132 are mounted.

A doctor blade supporting bracket 182 is located on either side of the casting drum 10' and as seen in FIG. 5 is pivotally mounted on hollow shafts 214, 216. Rotation of the doctor blade support brackets 182 is prevented by a strut which extends from the bracket to a frame member (not shown). A shaft 188 is supported by bearings in the doctor blade and rotatably mount the lower cutter wheels 134. Ring gears 190, 192 (shown best in FIGS. 6 and 8) mounted to respective cheeks 22*a*, 22*b* engage drive gears 194, 196 attached to and forming part of the upper cutters 132 so that the cutter shaft 178 driven by sprocket 1001 (on head shaft 300) which drives sprocket 1000 through chain 1002 insures the synchronization of the strip 40', the belt 14' and the drum 10'.

As indicated above, the yoke assembly 148 which rotatably supports the casting drum 10' is spring biased by an adjustable spring assembly 150. In particular, the yoke assembly 148 includes a pair of lateral support members 148*a*, 148*b* interconnected at one end by a cross piece 200. A pillow block 202 (shown best in FIG. 5) is bolted to each lateral member and pivotally supports the yoke assembly about the head shaft 300.

The spring assembly 150 includes a threaded rod 204 fixed to an extension plate 206 that is attached to the frame member 162. A gusset plate 206*a* rigidizes the mounting of the extension plate 206. The threaded rod 204 extends through an apertured tab 208 extending from the yoke assembly 148. A spring 210 acting between a nut 212 and the tab 208 applies an adjustable spring biasing force to the yoke assembly 148.

The bearing assemblies 146 which are bolted to the lateral yoke members 148*a*, 148*b*, rotatably support hollow shafts 214, 216 attached to opposite sides of the casting drum 10'. The hollow shaft 214 communicates with a water outlet 218 through which cooling water is discharged from the inside of the casting drum 10' whereas the hollow shaft 216 communicates with a water inlet 219 through which cooling water is introduced into the casting drum 10'.

The inside of the casting drum 10' is preferably cooled by a fast moving fluid such as water. Design parameters such as quantity and velocity of water flow, drum and belt thickness and conductivity, etc., are varied by methods well known to those skilled in the art to provide adequate cooling of the casting and of the various machine parts.

Referring to FIG. 7, a cooling gap is defined on the inside of the casting drum 10' between an outer cylindrical shell 220 and an inner shell 222. Vanes 224 and inlet and outlet apertures (not shown) are arranged to pump trapped air from the drum by directing it to the outlet conduit (hollow shaft) 214. Water is directed into the drum 10' by the inlet conduit (hollow shaft) 216. The side cheeks 22*a*, 22*b* are cooled by spray nozzles or other suitable cooling arrangements known in the art.

The belt drive roller 104, as best shown in FIG. 8, comprises three equally spaced disc plates 226 fixed to a support hub 228. The support hub in turn is keyed to the through head shaft 300 which as described above is rotatably supported by the pillow blocks 170. With the disclosed construction, sufficient support for the belt 14' is provided by the rollers 116 while providing clearance and access space for the cooling conduits 120*b* (shown in FIG. 7) through which cooling water is sprayed onto the underside of the belt 14'.

Figure 9:
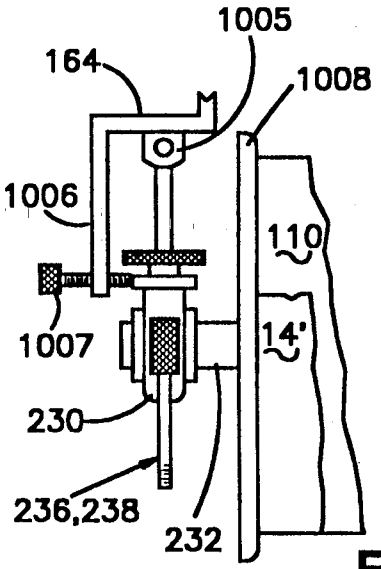
FIG. 9 is a side elevational view of a belt adjusting mechanism.

Turning now to FIGS. 5 and 9, belt position/tension adjustment indicated generally by the reference character 112 is illustrated. The apparatus 112 is used to make belt tracking adjustments to the belt 14'. In the illustrated embodiment, a pair of self-aligning pillow blocks 230 support an idler shaft 232 to which the idler drum 110 is attached. The pillow blocks 230 are adjustably supported below the frame cross pieces 164 by two parallel, downwardly extending rods 236, 238, each of which is swivelably supported on its upper end by clevises 1003, 1004. These clevises are pivoted on pins which also go through blocks 1005 which are affixed to frame 164. Threaded adjustment members 240, 242 adjust the vertical position (with respect to the cross piece 164) of the pillow block 230. A horizontal adjustment plate 244 bearing a pair of horizontally positioned adjustment screws 246 are used to adjust the horizontal position of the pillow block on the vertical threaded shafts. Apertures (not shown) in the pillow block 230 through which the vertical shafts 236, 238 extend are enlarged in order to allow relative, horizontal movement between the pillow block 230 and the shafts 236, 238.

Bearings 230 are self-aligning via spherical seats and the threaded rods 236, 238 (which appear on both sides of the machine) with their pivoting action working in conjunction with the swiveling action of the spherical bearing seats allow the shaft 232 to move in the direction of its length (i.e., in and out of the paper in FIG. 5).

A rigid tongue 1006 extending downward from either side of the machine frame 164 is fitted with an adjusting screw 1007 so that the roll 110 can be positioned sidewardly thus allowing pressure from flanges 1008 to be exerted on one edge or the other of belt 14' so that the belt is kept on track. The distance between the inside of the flanges on roll 110 is equal or just somewhat greater than the belt width.

Turning now to FIG. 6, details of the casting drum 10' and cheek mounting are illustrated. Each of the cheeks 22*a'*, 22*b'* defines an annular recess 250 to accommodate water cooling jets or sprays for cooling the cheeks 22*a'*, 22*b'*. The ring gears 190, 192 which run with the upper cutters 132 by way of gears 194, 196 are bolted to the side of respective cheeks by a plurality of threaded fasteners 256. As described above, surfaces 46' confronting and sealingly engage sides 48' of the casting drum 10'. The tapered surface 44' defines the ear receiving recess 50' on each side of the casting drum 10'. The tapered surface 44' defines the ear receiving recess 50' on each side of the casting drum 10' which increases in the radial and transverse dimensions as the end of the casting arc is approached.

The cheeks 22*a'*, 22*b'* are supported by ball bearings 262. Each cheek member defines a curved surface 266 defining an outer race for the bearings 262. A spring loaded annular member 264 defines an inner race engaged by the bearings. Threaded pins 268 acting against springs 270 are used to place an adjustable biasing force on the outer race member 264. The pins 268 are threadedly mounted in the support plate 172 which is bolted to support base 1009 (which is bolted to the cross piece 164).

Turning now to FIG. 8, the drive system for the machine is illustrated. As indicated above, a drive motor is used as a motive force for imparting rotation to the casting drum 10' and the belt 14' by means of a chain drive. In order to provide a means for driving the belt 14' and casting drum 10' in opposite directions and at slightly different speeds, the differential mechanism indicated generally by the reference character 109 is utilized. The differential mechanism comprises input and output side gears 288, 286 respectively positioned on each side of a pinion carrier 290 which rotatably carries at least two pinion gears 292 that are co-engaged by the side gears 286, 288. An input shaft 300 is driven by the drive motor through a chain drive or other suitable arrangement (shown on FIG. 5 as 108*a,b,c*). A sprocket 1010 freely turning on the input shaft 300 is operatively connected via sprocket chain 1011 to a drive sprocket 302 fixed to the drive shaft 216 for the casting drum 10' so that rotation of sprocket 1010 rotates the casting drum 10'. The speed of rotation of the casting drum is directly adjustable by adjusting the speed of the drive motor 108. Sprocket 1010 is turned in the opposite direction from shaft 300 (and rolls 100 and 104) by means which will now be described.

The input side gear 288 is rigidly affixed to the head shaft 300 through a conventional keyed hub arrangement 289. The differential carrier 290 includes a sprocket 312 which is connected to an auxiliary drive 314 by a chain or other suitable arrangement. When the differential carrier 290 is prevented from rotating, the rotation in the input shaft 300 will be transferred to the side gear 286 in a one-to-minus one relationship, i.e., one revolution of the input shaft 300 will produce one revolution in side gear 286 in the opposite rotational direction and hence the sprocket 1010 will drive sprocket 302 via chain 1011 which thus drives drum 10' through shaft 216 in the opposite direction to roller 104. The ratio of diameters of sprocket 1010 to sprocket 302 is nearly the same as the ratio of diameters of roller 104 to drum 10' so that the drum and belt surface speeds are nearly the same. If the auxiliary drive 314 is energized to cause the carrier 290 to slowly rotate, the speed of the output side gear 286 relative to the input side gear 288 will be reduced or increased depending on the direction and rate of rotation. By varying the speed of the auxiliary drive 314, precise differential speeds can be imparted to the drive sprocket 1010 to adjust for differences in surface speed between the casting drum 10' and the belt 14'. The auxiliary drive 314 may be powered by an adjustable electric motor, hydraulic drive motor and other drive mechanism known in the art.

In operation, the drive motor is adjusted to produce a desired surface speed of the belt in order to provide sufficient contact time for the molten metal in the casting arc 20'. The auxiliary motor driving the differential mechanism (when used) is then adjusted to produce the requisite surface speed of the drum 10'. Once the proper speeds have been reached, drum, belt and cheek cooling water is turned on and molten metal is introduced into the casting arc 20' by way of a conduit 316 which feeds molten metal to a downwardly direct nozzle 318. It should be noted that other arrangements for introducing molten metal are also contemplated by the present invention and this invention should not be limited to the disclosed conduit and nozzle. Additional post nip strip cooling sprays (not shown) are also of value to further reduce the temperature of the off coming strip.

Figure 10:
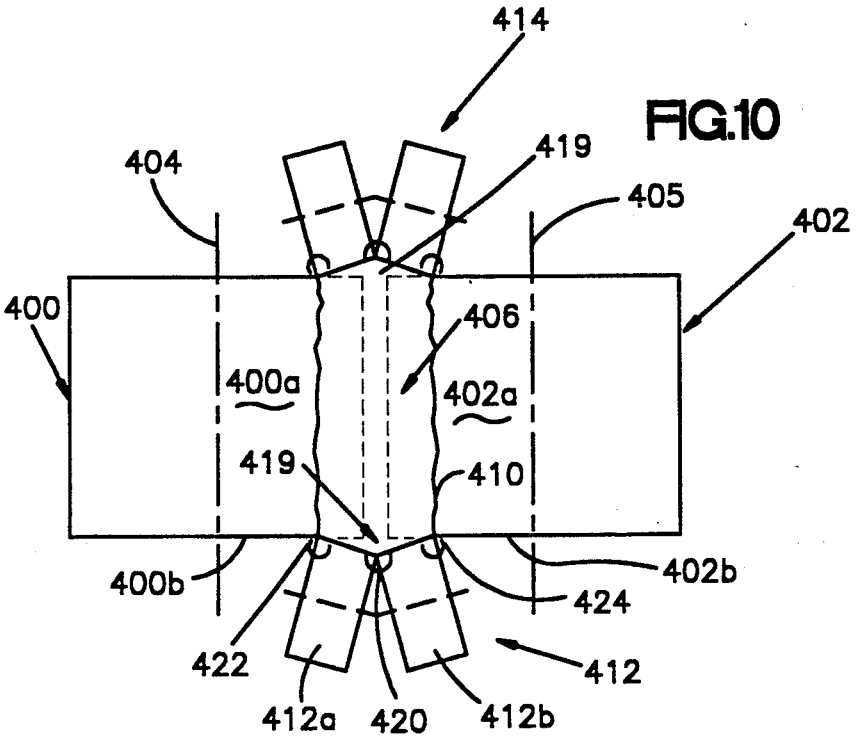
FIG. 10 is a top plan view of a Bessemer-type embodiment of the present invention, shown somewhat schematically.
Figure 12:
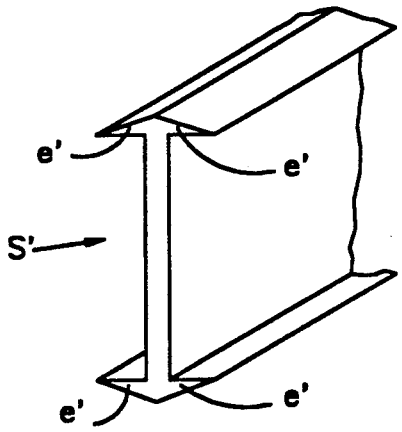
FIG. 12 is a view of the cast strip as seen from the plane indicated by the lines 12—12 in FIG. 11.
Figure 11:
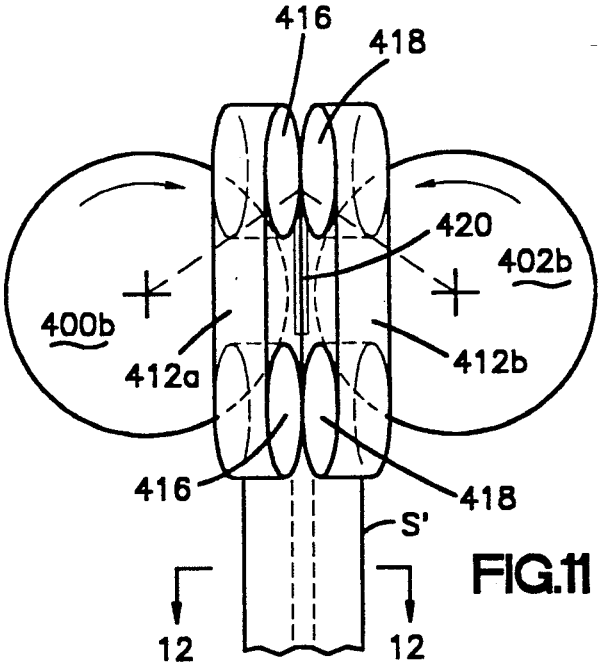
FIG. 11 is a side-elevational view of the apparatus shown in FIG. 10.
Figure 14:
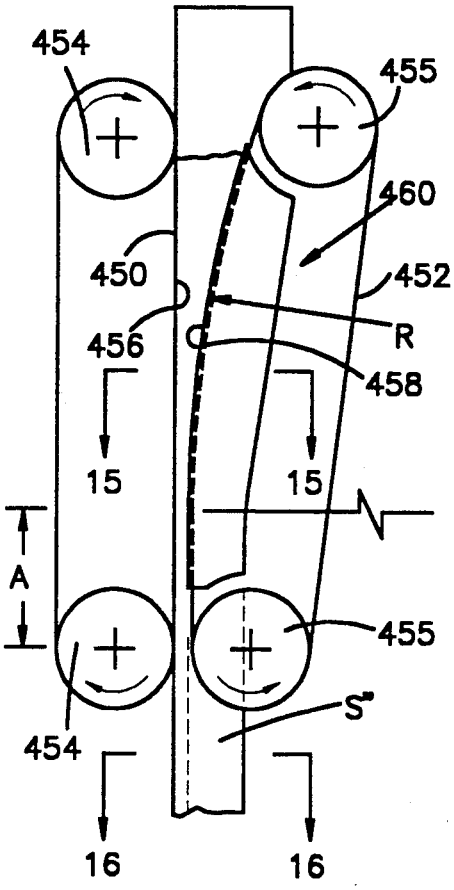
FIG. 14 is a sectional view as seen from the plane indicated by the line 14—14 in FIG. 13.
Figure 13:
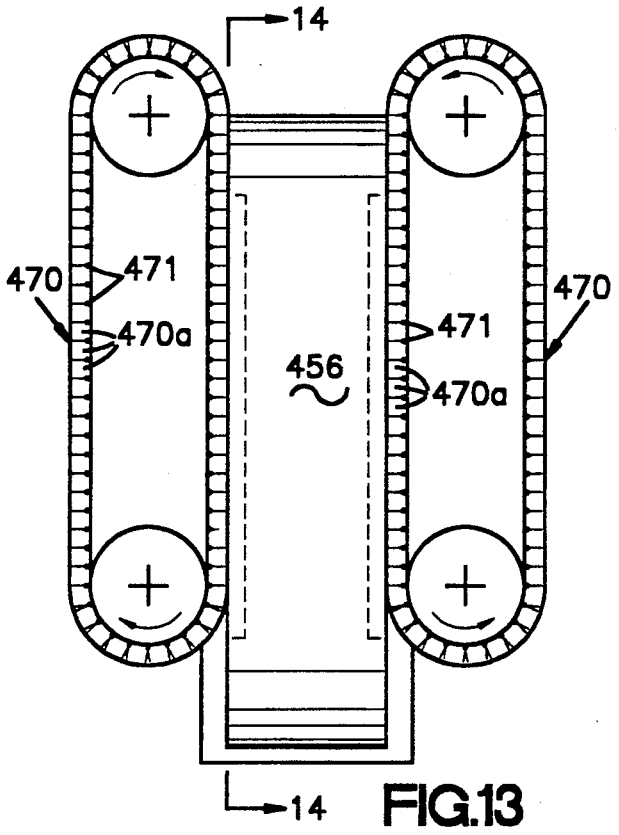
FIG. 13 is a side elevational view of another embodiment of the invention as applied to a converging belt type machine, shown somewhat schematically.

Turning now to FIGS. 10–12, another embodiment of the invention is illustrated. In this embodiment, the principles of the invention are applied to a Bessemer type machine. As is known, in a Bessemer machine, two parallel rolls 400, 402 rotate about horizontal axes 404, 405. The rolls 400, 402 define converging casting surfaces 400*a*, 402*a*, respectively. A nip indicated generally by the arrow 406 is defined between the rolls and determines the casting thickness of the strip.

A molten pool 410 is confined between rolls 400, 402 above the nip 406 by edge constraints formed by pairs of belts indicated generally by the reference character 412, 414. Edge constraint 412 is defined by a pair of belts 412*a*, 412*b* reeved around pulleys 416, 418. The belts 412*a*, 412*b* are positioned in a juxtaposed, but angled position. Outer edges of the belts ride against respective sides 400*b*, 402*b* of the casting rolls 400, 402. As in the first embodiment, the belts in effect define expanding recesses associated with the sides of the roll. These recesses accommodate the growth of the ears e' as the cast strips s' is formed on the casting surfaces 400*a*, 402*a*. The ears e' are formed on the surfaces of the belts 412*a*, 412*b* and the sides of the rolls 400*b*, 402*b* that are in confronting relation with each other.

Unlike the first embodiment, the strip formed by this embodiment is substantially an "I-beam" in cross section as seen in FIG. 12. In the preferred arrangement, the belts forming a given pair abut each other near the center line of the strip. Preferably guides or belts restraints 420, 422 and 424 are used to inhibit leakage of molten material at the belt junctures and the belt/drum junctures. With the disclosed arrangement, the recesses defined by the belts on either side of the roll 400, 402 accommodate the ears as they are formed during the casting process so that ear crushing or interference does not occur at the nip.

Figure 15:
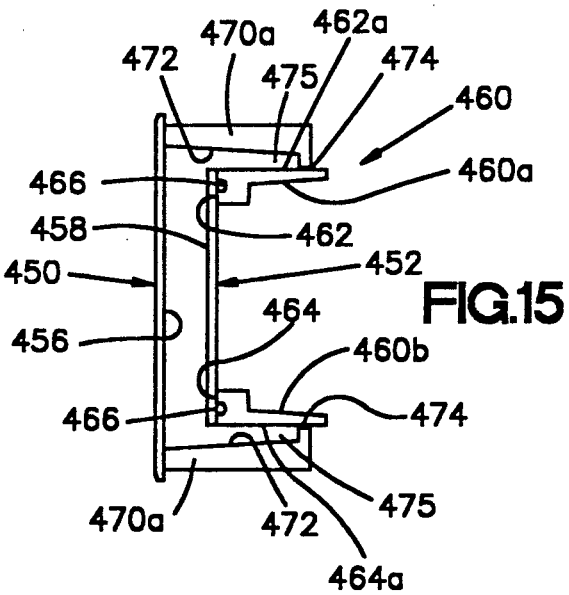
FIG. 15 is another sectional view as seen from the plane 15—15 in FIG. 14.

Turning now to FIGS. 13–16, the invention is illustrated as it would be embodied in a converging belt-type machine. In this embodiment, casting surfaces are defined by a pair of continuous belts 450, 452 which are reeved about rollers 454, 455, respectively. In the preferred construction, the belt 450 is substantially vertically oriented and defines a vertical casting surface 456. The belt 452 defines an arcuate casting surface 458 that converges towards the belt 450. The curved path for the belt 452 is provided by a guide 460 which includes, as best seen in FIG. 15 side members 460*a*, 460*b*. The belt 452 rides along edge surfaces 462, 464 defined by the side members. Seal members 466 may be provided to prevent leakage of molten material between the side members 462, 464 and the underside of the belt 452.

Figure 15A:
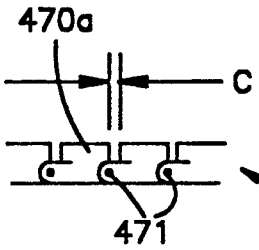
FIG. 15*a* is a fragmentary side-elevational view of the belt of cheek blocks.

As seen in FIG. 15, the belt 452 is preferably narrower than the confronting belt 450. The molten pool is contained by edge constraints which are each defined by a belt of cheek blocks 470. As seen in FIG. 15, each individual cheek block 470*a* is tapered in cross section and includes an inner recess-like surface 472 which curves inwardly and merges with a substantially flat side surface 474. As shown in FIG. 15*a*, the individual cheek blocks 470*a* are pivotally interconnected by pins 471. The space C between the blocks 470*a* is provided to permit the belt to bend around the rollers without the blocks binding-up. This space is sufficiently small, however, that the surface tension of the molten metal prevents the metal from entering the space. The side surface 474 abuttably engages a side surface 462*a*, 464*a* of the associated guide member 460*a*, 460*b*.

Figure 16:
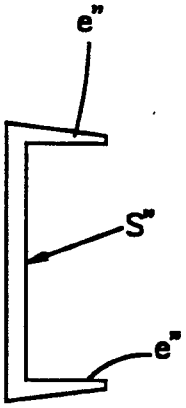
FIG. 16 is another sectional view as seen from the plane indicated by the lines 16—16 in FIG. 14.

In the preferred arrangement, the belts of blocks 470 move in synchronism with the belts 450, 452. Because of the curvature of the guide 460, an expanding recess is defined between each belt of blocks 470 and the associated side surface of the side members 460*a*, 460*b*, as the end of the casting arc is approached. With this arrangement, the growth of the ears is accommodated as the strip being cast proceeds from the top of a molten pool to the end of the casting arc. As seen in FIG. 16, the resulting strips s''' is substantially U-shaped in cross section with tapered ears e'' defining the legs of the U.

Figure 17:
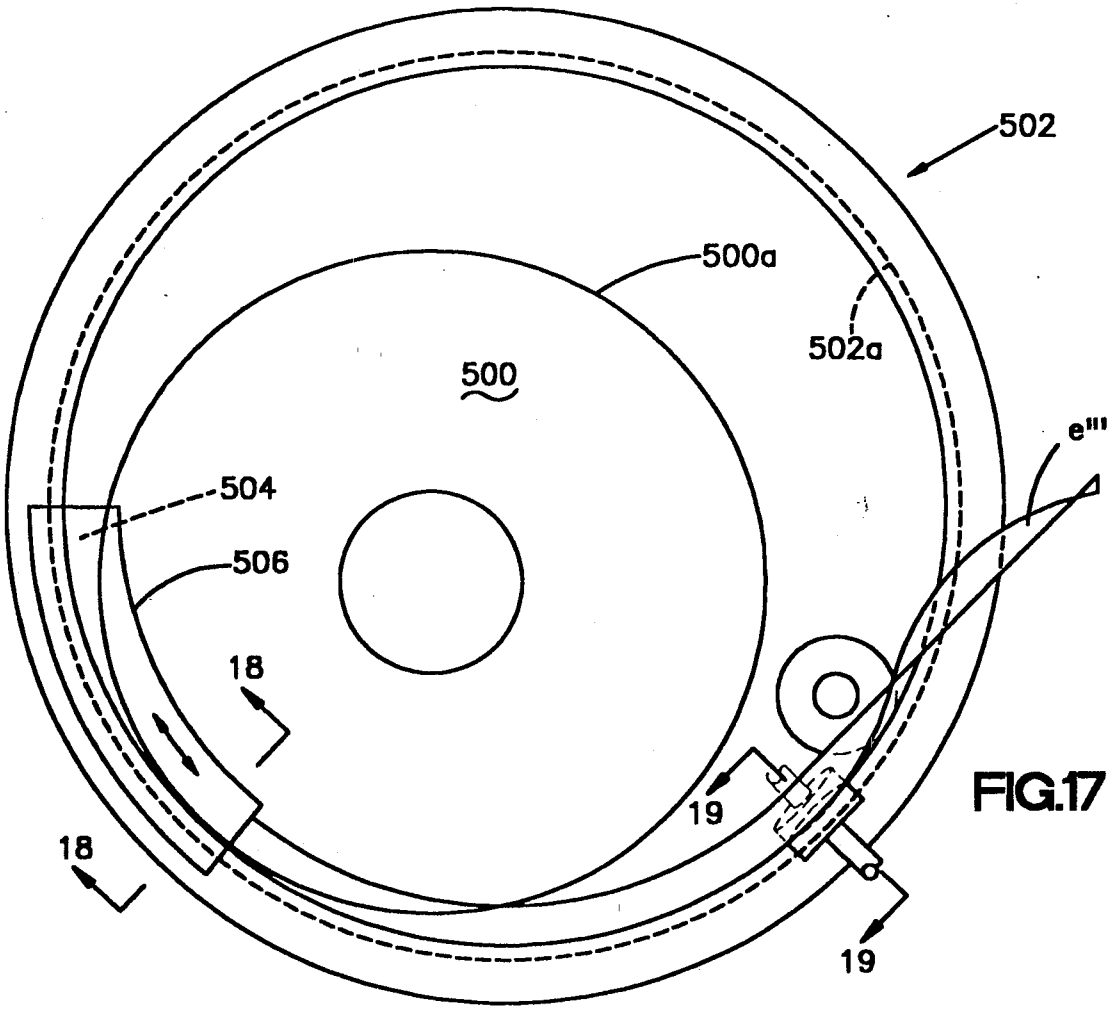
FIG. 17 is a side elevational view of another embodiment of the invention as applied to an in-the-ring type machine, shown somewhat schematically.
Figure 19:
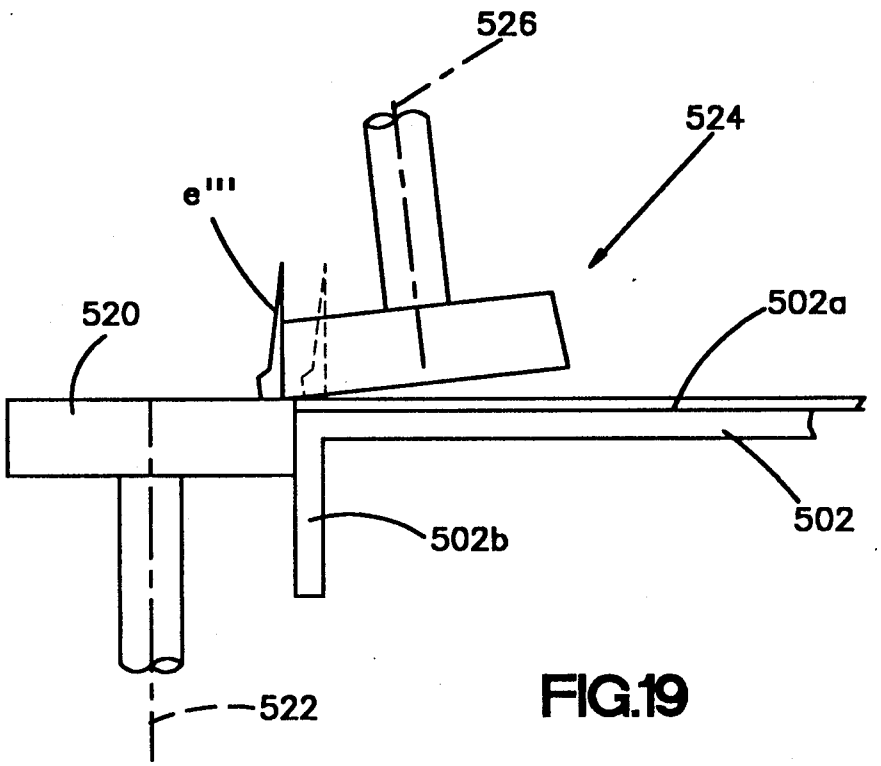
Figure 18:
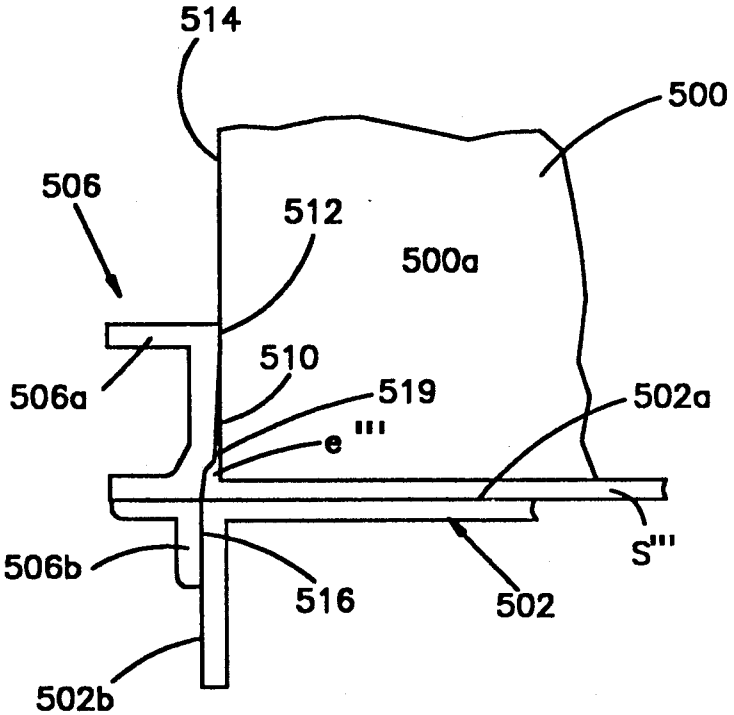
FIG. 18 is a sectional view as seen from the plane indicated by the line 18—18 in FIG. 17; and, FIG. 19 is another sectional view as seen from the plane indicated by the line 19—19 in FIG. 17.

FIGS. 17–19 illustrate another embodiment of the invention. In this embodiment, the principles of the invention are adapted to an "in-the-ring" (ITR) type machine. The machine is defined by a drum 500 rotating within or inside a ring 502. Casting surfaces are defined by a cylindrical surface 500*a* defined by the exterior of the drum 500 and an inner cylindrical surface 502*a* defined by the inside of the ring 502. A converging casting arc 504 is defined between the drum and the ring. The molten pool is contained by edge constraints (only one is shown) which are defined by oscillating cheeks 506. Methods and apparatus for oscillating the cheeks are known and are considered conventional and therefore the mechanism for producing oscillations in the cheek 506 will not be discussed further.

As seen in FIG. 18, the cheek 506 is an arcuate segment in configuration and has radius of curvature that preferably conforms to the radius of the ring 502. The cheek 506 defines a tapered surface 510 which merges with a side surface 512. The side surface 512 abuttably engages a side 514 of the drum 500. The cheek 506 also includes a ring engaging portion 506*b* which includes a side surface 516 that rides against a side 502*b* of the ring 502. As is the case with the other embodiments, each cheek 506 defines an ear accommodating recess that expands in the radial direction as the end of the casting arc is approached. In this way, the growth of ears e''' as the strip s''' is formed between the casting surfaces, is accommodated.

In this embodiment, the cast strip s''' is substantially U-shaped in cross section with the ears e''' defining the legs of the "U". As seen in FIGS. 17 and 19, a mechanism for trimming the ears from the cast strip is illustrated. The trimmer includes a cutter wheel 520 rotatable about a substantially vertical axis 522 which also rides against the side 502*b* of the ring 502. A second cutter 524 rotatable about a slightly skewed axis 526 overlaps the edge of the cutter 520 and thus cuts the ear from the strip as the ear passes between the cutters. As seen in FIG. 17, the trimmed ears spiral from the ring 502. The strip itself also spirals from the inside of the ring in the conventional manner.

In another preferred embodiment, shown in FIGS. 20–26, an alternative yoke assembly is detailed. The yoke assembly is comprised of a pair of lateral yoke arms, a casting drum support mechanism, an adjustable spring assembly for biasing the casting drum support mechanism towards the casting belt 14', and a drum extension mechanism for casting length adjustments. Many components in FIGS. 20–25 have similar counterparts as in FIGS. 1–9 and will be designated with the same reference character followed by a prime (′). New features specific to this embodiment will be designated with 5000 reference numbers. Various features common to the embodiments of FIGS. 1–9 and FIGS. 20–25 have been deleted for clarity.

The yoke assembly 148' is pivotable about a third axis (f) to facilitate casting belt 14' replacement and maintenance. The yoke assembly 148' rotatably supports a drum extension member 5002 (FIG. 21A) and the casting drum support member 5004 (FIG. 22A) about a fourth axis (g).

The yoke assembly 148' includes a pair of lateral support members 148*a'*, 148*b'* (shown in FIG. 24) interconnected near one end by cross piece 200'. A hinge block 5006, (FIG. 20) is attached to each lateral member 148*a'*, 148*b'* and pivotally supports the yoke assembly 148' for rotation about the axis (f) via pivot pin 5005. The pivot pin 5005 is supported by stationary hinge block 5013.

Figure 20:
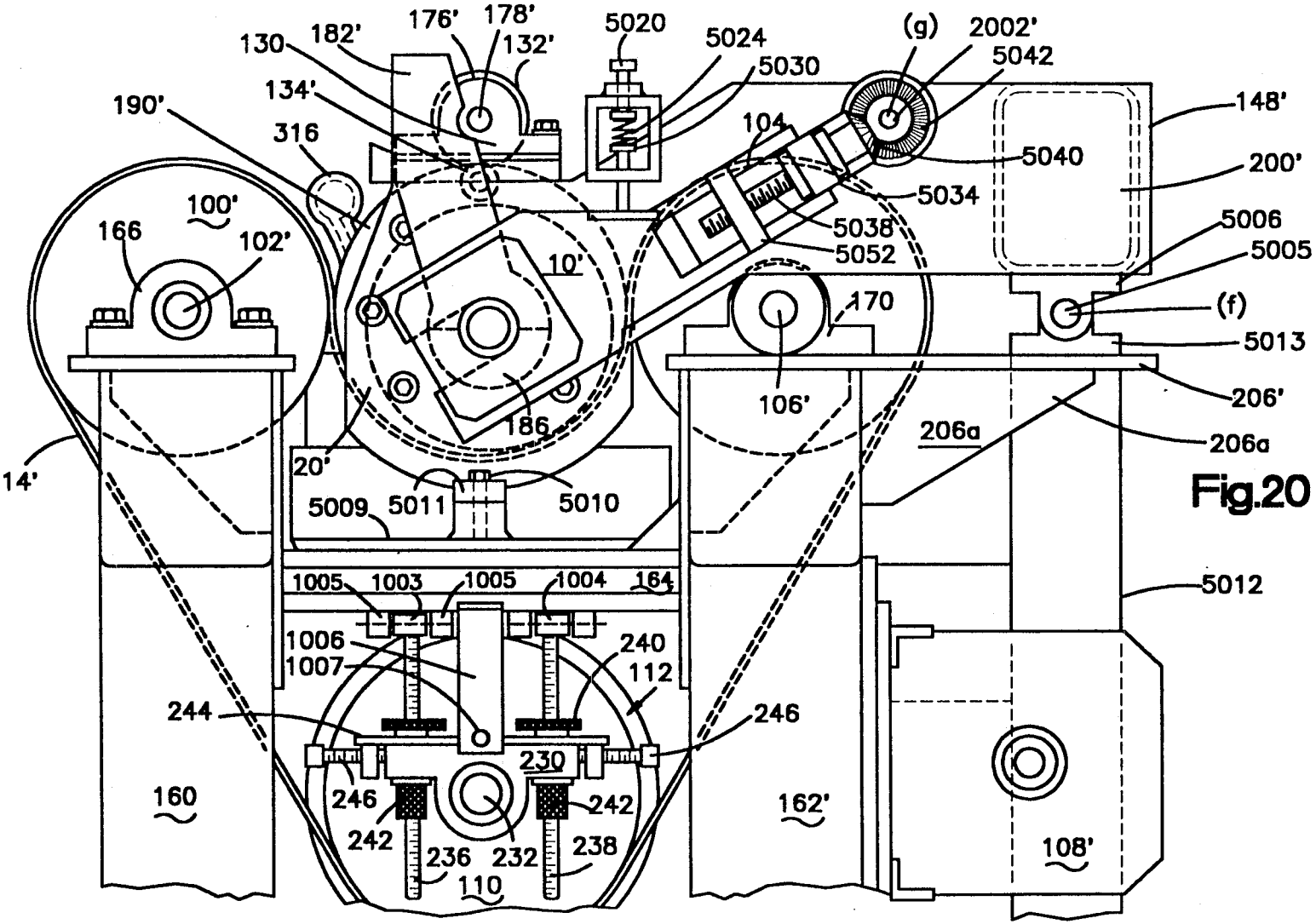
FIG. 20 is a sectional view of the casting machine of FIG. 5 embodying another preferred embodiment of the present invention as seen from the plane indicated by the line 20—20 in FIG. 24.

An extension plate 206' for supporting the hinge block 5006 of FIG. 20 is attached to the frame member 162'. A gusset plate 206*a* rigidizes the mounting of extension plate 206'. The remaining hinge block 5006 is supported by a stanchion 5012 so that no frame member interferes with belt removal and replacement.

The yoke lateral support members 148*a'*, 148*b'* extend from the axis (f) to the drum 10', bending in a neck-like fashion near the drum 10' area. A pair of cheek support members 5003*a* (only one shown in FIG. 23) are bolted to the lateral support members 148*a'*, 148*b'*. Each cheek support member 5003*a* carries a stop bolt pad 5011. A positive stop bolt 5010 (FIG. 20) passes through stop bolt pad 5011 to secure the cheek support members to cross member 5009. The stop bolt 5010 prevents movement of the cheek support members 5003*a* and the entire yoke assembly 148' during operation of the apparatus. Belt 14' replacement is achieved by releasing positive stop bolt 5010 and rotating the yoke 148' up and away from the machine.

Figure 23:
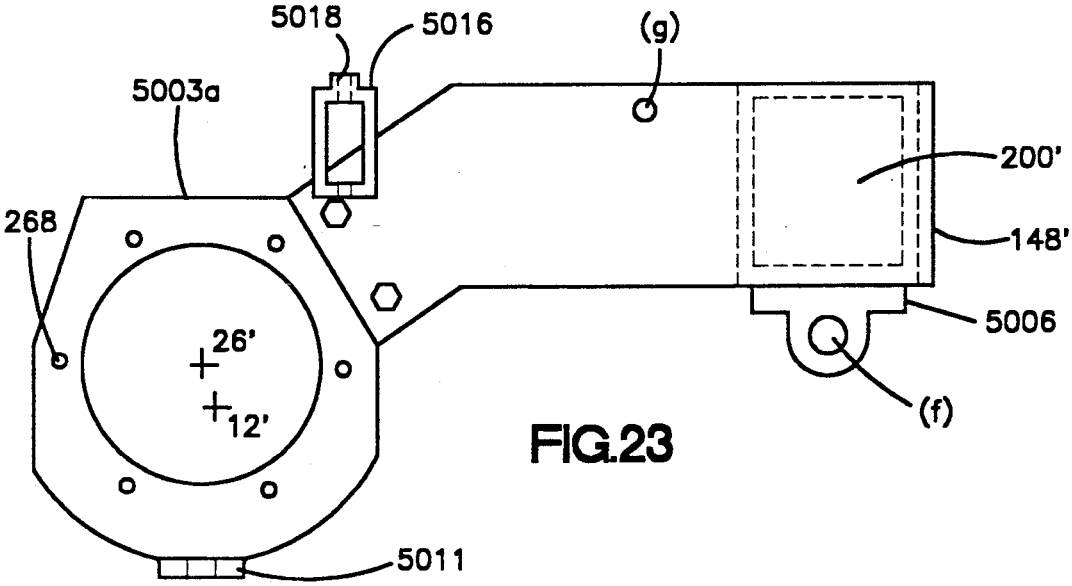
FIG. 23 is a plan view of the yoke member shown in FIG. 20.

The cheek support members 5003*a*, also have bearing means 262 (as shown in FIG. 6) to rotatably support the cheeks 22. Each cheek 22 is annular or ring-like in construction. The cheek support members 5003*a* define an axis of rotation 26' for the cheek members 22. The axis 26' is spaced from the axis of rotation 12' of the drum 10' (FIG. 23, see also FIG. 1). As in the embodiment of FIG. 1, the radial distance between the peripheral surface 22*a* and the axis of rotation 26 is larger than the radius of the casting surface 10*a* of the drum 10. Additionally, while the bearing means 262 permits cheek 22 rotation about the axis 26, they also restrict lateral movement of the cheeks 22.

As shown in the embodiments of FIGS. 2–4, the cheek members 22, define an inner tapered surface 44 and a radial abutting surface 46 to slidably engage a side of the drum 48 to define a closed ear cavity or recess 50 when the cheeks move through the casting arc 20. The coaction of the cheeks 22 and surfaces 44, 46 of the closed ear cavity replicates the novel edge containment means described previously.

Figure 20A:
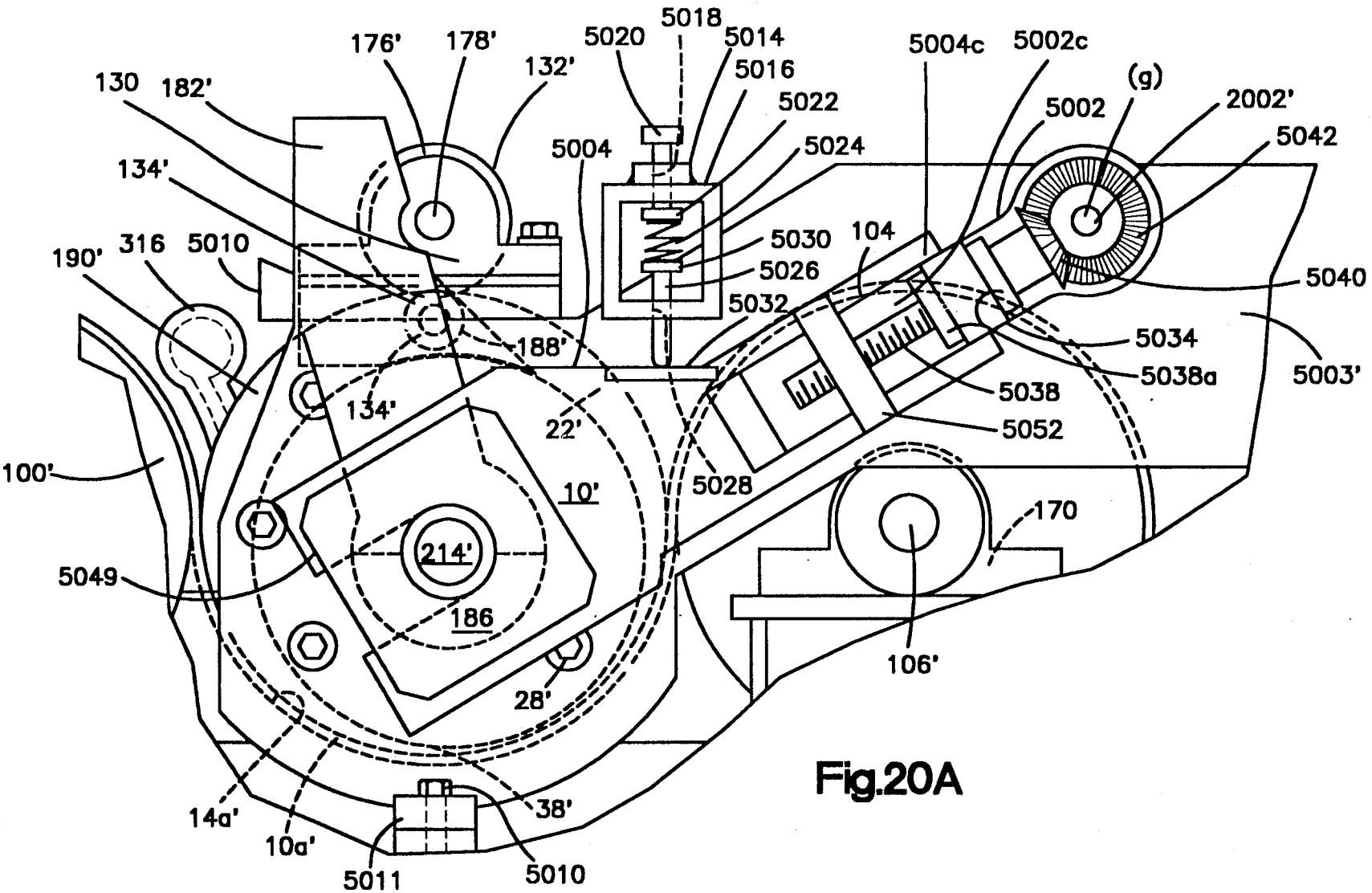
FIG. 20A is an exploded elevational view of the drum extensions means of the embodiment of FIG. 20A.

Additionally, the lateral support members 148*a'*, 148*b'* support an adjustable spring assembly 5014 (FIG. 20*a* ). The adjustable spring assembly 5014 includes a bracket 5016 attached to the yoke assembly 148. The bracket includes a threaded aperture 5018. A threaded rod 5020 extends through the aperture 5018. The rod 5020 has a cup-like end 5022 to accept a coil spring 5024. A second rod 5026 extends through an aperture 5028 in the yoke 148'. The second rod 5026 has a cup-like end 5030 to accept the spring 5024. This second rod 5026 presses on the plate 5032 which is part of 5004. The spring 5024 acts between the cup-like end 5022 of the threaded rod 5020 and the cup-like end 5030 of the second rod 5026 to apply biasing force to the casting drum support mechanism 5004.

Figure 21A:
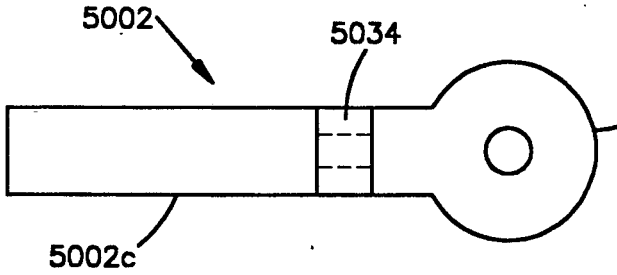
FIG. 21A is a plan view of the extensible drum ram member shown in FIG. 20.

The lateral support members 148*a'*, 148*b'* also act with drum extension member 5002 to define the fourth axis (g). The drum extension member 5002 has two arm members 5002*a*, 5002*b* each having a tongue-like portion 5002*c* (FIG. 21A). The members 5002*a* are located on either side of the roll 18' (FIG. 24), outside and adjacent to each lateral support member 148*a'*, 148*b'*. The members 5002*a* are pivotally connected to, and rotate about head shaft 2002', defining axis (g).

Figure 21B:
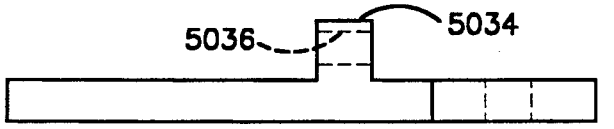
FIG. 21B is a top plan view of the extensible drum ram member shown in FIG. 21A.
Figure 24:
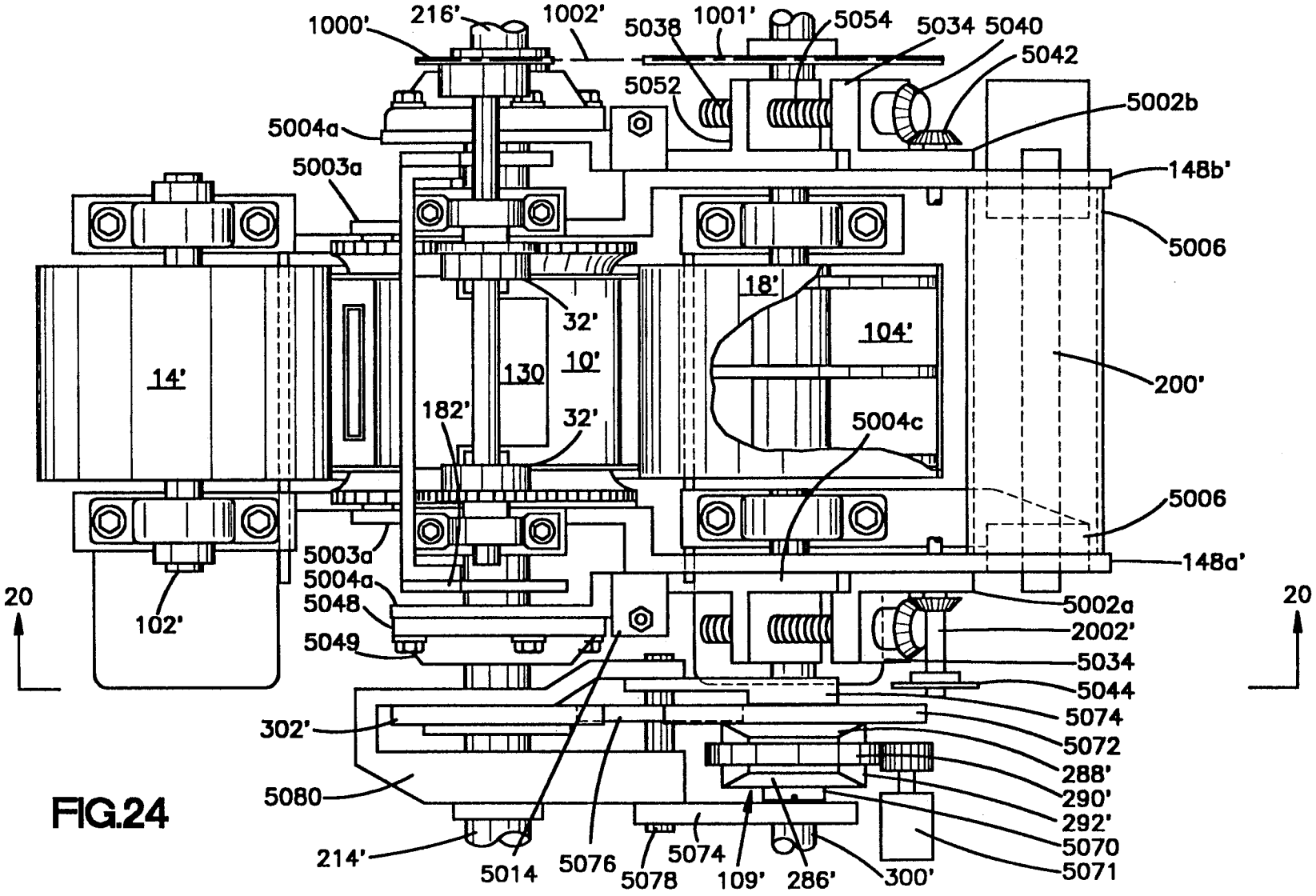
FIG. 24 is a top elevational view of the machine shown in FIG. 20.

Each drum extension arm 5002*a* has an outward extension tab 5034 having a aperture 5036 (FIGS. 21A, 21B). A pair of oppositely threaded drum extension rods 5038 with miter gear heads 5040 extend through each aperture 5036 (FIG. 24). The miter gear heads 5040 coact with corresponding miter gears 5042 mounted on head shaft 2002.

The casting drum support mechanism 5004 is comprised of two drum support elements 5004*a*, (only one shown in FIG. 22A, 22B) and a drum support stem 5004*c* for each element. Each casting drum support element 5004*a* is disposed about the hollow shaft 214', 216' and adjacent to the lateral arm members 148*a'*, 148*b'* (FIGS. 20A, 24). The elements 5004*a* also define slot 5050 for relatively easy disposal onto the hollow shaft 214'. Additionally, each element 5004*a* has attachment means 5048 (FIG. 22A) to facilitate the attachment of a flanged pillow block 5049 (FIG. 24). Pillow block 5049 supports bearing means which allow rotation of the drum 10' and hollow shaft 214' (FIG. 24) about axis 12'.

Figure 22A:
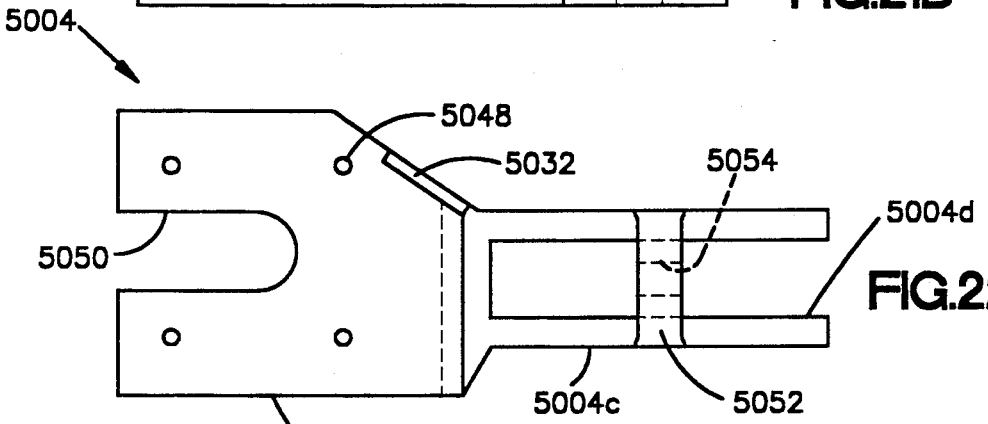
FIG. 22A is a plan view of the drum support member shown in FIG. 20.
Figure 22B:
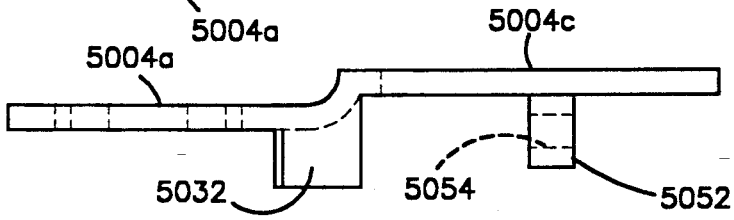
FIG. 22B is a top plan view of the drum support member shown in FIG. 22A.

The casting drum support stem 5004*c* (FIG. 20A, 22A) coacts with the drum extension member 5002 in a sheath-like fashion. Each stem 5004*c* is disposed outside and adjacent to the lateral arms 148*a*, 148*b*. (FIG. 24) Each drum support stem 5004*c* defines an elongated rectangular slotted portion 5004*d* which receives the drum extension member shaft 5002*c*. Each drum support stem 5004*c* also includes an outward drum support tab 5052 with threaded apertures 5054 (FIGS. 22A and 22B). The threaded apertures 5054 engage the oppositely threaded drum extension rods 5038. As described above, the extension rods pass through the drum extension tab 5034 and aperture 5036 and connect, in driving relationship, with the head shaft 2002 (FIG. 24) through miter gears 5040, 5042. Lock collars 5038*a* prevent axial movement of the drum extension rods 5038 with respect to the drum extension member 5002.

A doctor blade 130' is supported above the casting drum 10' and cheek support members 5003' by a mounting plate 5010 (FIG. 20A). Pillow blocks 176' rotatably support a shaft 178' to which the upper cutters 132' are mounted. A shaft 188' is supported by bearings in the doctor blade 130'. The shaft rotatably supports the two cutters 134'. Upper cutters 132' are driven through coaxially mounted gears 194,196 which are driven by lower ring gears 190, 192 mounted to respective cheeks 22*a'*, 22*b'* as in FIG. 6. The drive gears 194, 196 (FIG. 8) are attached to and form part of the upper cutters 132' (FIG. 20). The cutter shaft 178' is driven by sprocket 1001' (FIG. 24). The sprocket 1001' drives sprocket 1000' through chain 1002', insuring the synchronization of the strip 40 (FIG. 1), the belt 14', the drum 10', and the top cutter wheels 132', 134'.

The mounting plate 5010 (FIG. 20A) is attached to bird-leg plates 182'. The bird-leg plates 182' are pivotally mounted on hollow shafts 214', 216' between the drum support mechanism and the cheek support members 5003.

Figure 26:
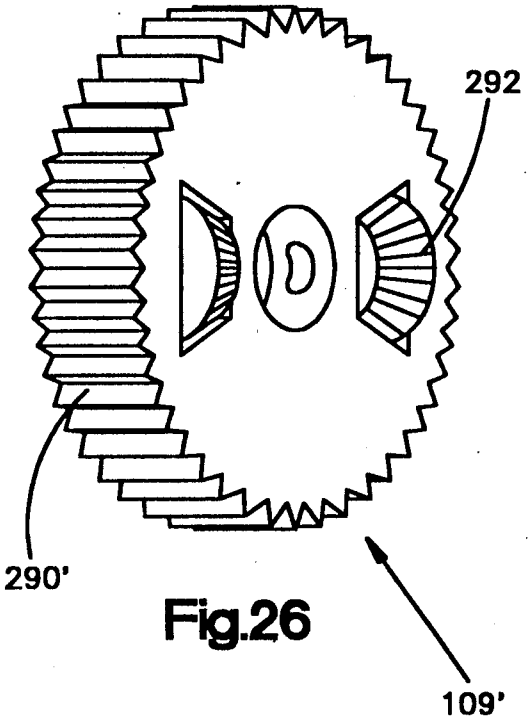
FIG. 26 is side elevational view of the differential pinion carrier of FIG. 25.
Figure 25:
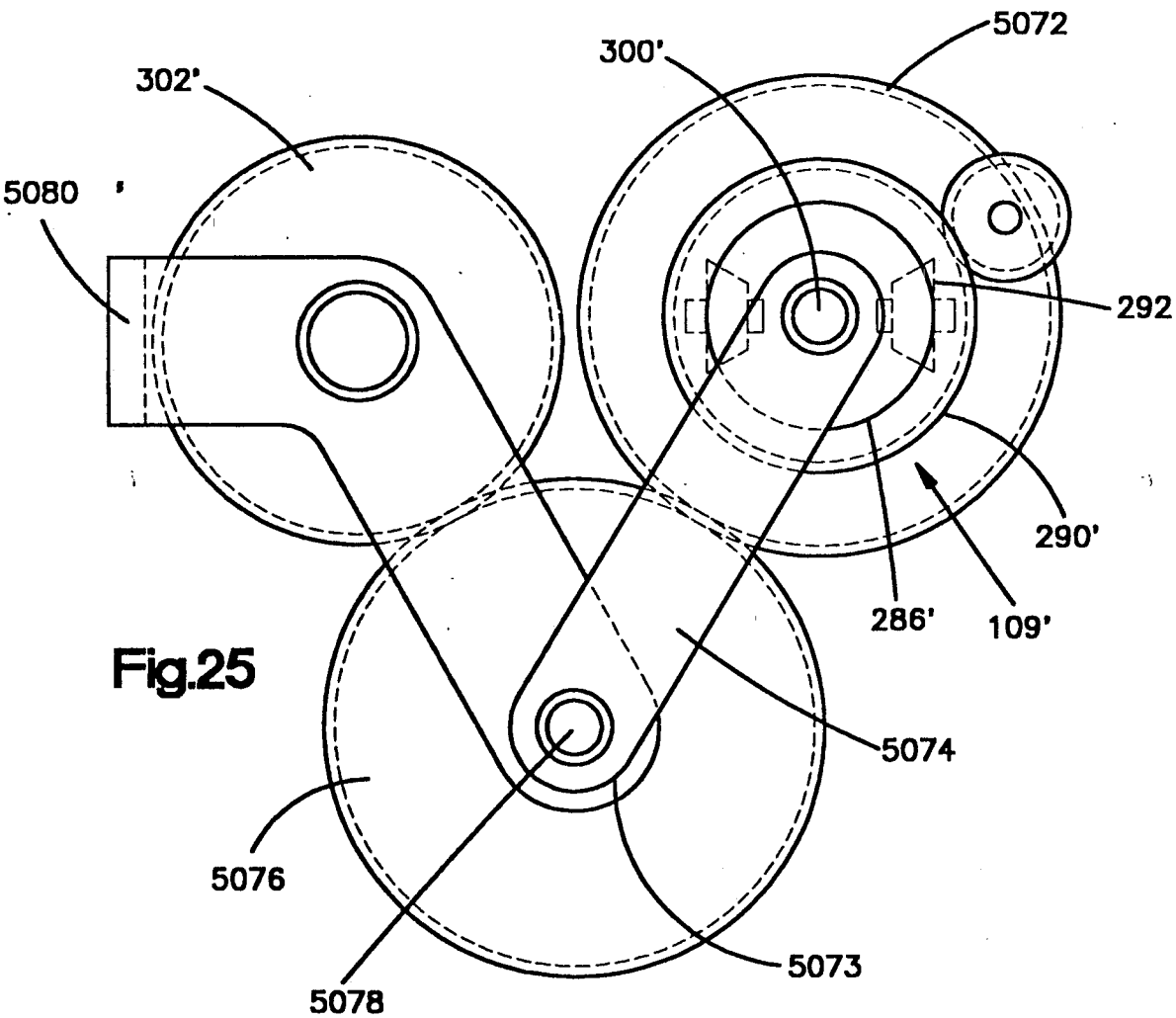
FIG. 25 is a plan view of the modified drive assembly of FIG. 20.

Turning now to FIGS. 24–26, the modified drive system for this embodiment is illustrated. Since many of the features of this system (i.e. gear/speed ratios) correspond to the drive features previously described, only new features will be described.

As in the embodiments described above, a drive motor is use to impart rotation to the drum 10' and the belt 14' by direct drive means. A differential assembly 109' is used to provide means for driving the headshaft 300', driving belt 14' and drum 10' in opposite directions and at slightly different speeds as described in connection with FIG. 5.

The differential mechanism comprises input side bevel gear 286' rigidly secured to shaft 300' through a conventional keyed hub arrangement 5070. Input side bevel gear 286' coacts in direct driving relationship with at least two pinion bevel gears 292' carried within the bevel pinion carrier 290'. The pinion carrier 290' rotates freely about shaft 300' and coacts with drive motor 5071. Drive motor 5071 is used to accomplish fine speed adjustment of the drum 10' relative to the belt 14'.

The bevel pinion gears 292' coact in driving relationship with output side bevel gear 288'. Output side bevel gear 288' is rigidly attached to spur gear 5072, with both output side gear 288' and gear 5072 being rotatably driven in the opposite direction of input side gear 286' and shaft 300'. Shaft 300' also carries a first pair of scissor arms 5074 of scissor mechanism 5073 to hold gear 5072 in direct driving relationship with idler gear 5076.

Idler gear 5076 rotates freely about idler shaft 5078 and carries a second pair of scissor arms 5080 to allow the idler gear 5076 to coact, in driving relationship with drive gear 302'. The idler gear 5076, and shaft 5078 pivotally hang from scissor arms 5074, 5080 so that the idler gear is positioned below and under drive gear 5072 and drive gear 302'. As described previously, drive gear 302' drives drum 10' through shaft 214' in the opposite direction of roller 104'.

In operation, a first belt support roll 100' is supported on a tail shaft 102'. (FIG. 20, 20A) The casting belt 14' is reeved under the casting drum 10', cheek assembly, and around drive roll 104'. The casting drum 10' is biased against the belt 14' by the constant pressure of the spring assembly 5014. Drive roll 104' is supported for rotation by head shaft 300' and driven by motor 108' (as in FIG. 5). As in FIG. 1, molten metal is delivered into the gap 20 by a nozzle 30. As the drum 10 and cheeks rotate, molten metal freezes between the belt 14 and the drum 10. The thickness of the strips 32,34 (FIG. 1) increases as the strips move towards the end of the arc 38. The cast strip 40 (FIG. 1) then proceeds through an additional arc of travel, maintaining contact with the belt until the belt is stripped from the casting when it changes curvature by being payed onto roll 18.

In many instances during the operation of the apparatus, it is desirable to adjust the cast arc length while holding cast thickness and speed constant. Adjustment to the cast arc length increases production, promotes constant input conditions, and compensates for decreasing molten metal input temperatures.

Adjustment of the cast arc length occurs by applying an external power source to the sprocket 5044, to rotate the head shaft 2002' (FIG. 24). As the head shaft 2002' rotates, the oppositely threaded rods 5038 with miter gear heads 5040 rotate in opposite directions simultaneously. The rods 5038 coact with the threaded drum support apertures 5054, applying an extension or contraction motion to the drum support stem 5004*c* (FIG. 20A) through the drum support tabs 5052. Drum support stem 5004*c* guides slotted portion 5004*d* longitudinally over the surface of the drum extension tongue 5002*c*. As the drum support stem 5004*c* is driven away from, or towards, the head shaft 2002, the drum support elements 5004*a* move to increase or decrease, respectively, casting arc length. This movement of the drum 10' occurs without impairing the closed ear cavity comprising the novel edge containment means described previously. (FIGS. 2–4)

Additionally, as the casting arc length is increased or decreased, an articulated strut (not shown) impedes horizontal movement of mounting plate 5010, obviating the need for adjustments to cutter assemblies 132', 134' or the doctor blade 130'.

Increasing or decreasing the casting arc length automatically adjusts the drive system through the scissor mechanism 5073. As the drum support elements 5004*a* are moved within the cheek support member diameter 5060 to extend or contract the casting arc, shaft 214' causes the scissor mechanism 5071 to flex about scissor shaft 5078 repositioning the drive sprocket 312' in relation to the idler gear 5076, and the idler gear in relation to sprocket 5072 to maintain the direct driving relationship. Sprocket 5072 remains positioned about shaft 300' to anchor scissor mechanism 5073.

Although the invention has been described with a certain degree of particularity, it should be understood that those skilled in the art can make various changes to it without departing from the spirit or scope as hereinafter claimed.

I claim:

1. Apparatus for continuously casting strip material, comprising:

a) a casting drum rotatable about a first axis of rotation;

b) a pair of cheek members positioned on either side of a first casting surface defined by said casting drum and rotatable about a second axis, spaced from said first axis;

c) a casting belt reeved around at least a portion of said cheek members and defining a second casting surface spaced from said first casting surface, said belt and casting drum forming a casting arc;

d) each of said cheek members defining a peripheral surface engageable by marginal edges of said belt for maintaining a predetermined spaced distance between said casting surfaces and an inner sealing surface engageable with a side surface defined by said casting drum for a predetermined arc of rotation of said drum;

e) said eccentric mounting of said cheek members with respect to said casting drum causing said spacing between said drum casting surface and said belt casting surface to decrease as an end of said casting arc is reached such that a converging casting arc is defined.

f) means for managing and accommodating ear material formed on a portion of each cheek member as said cheek members rotate through said casting arc.

2. The apparatus of claim 1 wherein said portion of each cheek member defines a surface tapering in the radial direction such that in said casting arc, a recess is defined between a portion of each cheek member and a portion of said casting drum that increases in the radial direction as the end of the casting arc is approached so that an expanding recess is provided for receiving ear material during a casting operation.

3. The apparatus of claim 1 wherein each cheek member is biased toward sealing engagement with a side of said casting drum by spring or other biasing means.

4. The apparatus of claim 3 wherein each cheek member is annular in configuration and defines a bearing race engageable with a bearing means that supports each cheek member for rotation about said second axis.

5. The apparatus of claim 1 wherein a radius of said peripheral surface of said cheek member is larger than a radius of a casting surface defined by said casting drum.

6. The apparatus of claim 1 wherein each cheek member defines a bearing race engageable with a yoke, the yoke supporting the cheek members and being supported for rotation about a third axis, said yoke having lateral members that support each cheek for rotation about the second axis and a drum extension mechanism whereby the casting arc length is increased or decreased upon the expansion or contraction of said extension mechanism.

7. The apparatus of claim 6 wherein the drum extension mechanism is rotatably supported about a fourth axis defined by the yoke.

8. The apparatus of claim 6 wherein the yoke is comprised by a pair of lateral members, each rotatable about a third axis, said lateral members carrying bearing means for rotatable support of said cheek members and a biasing means to bias the casting drum toward said belt casting surface.

9. Apparatus for continuously casting strip material such as strip steel, comprising:

a) a casting drum defining a casting surface having a radius of rotation about a first axis;

b) said casting drum defining side surfaces extending from opposite sides of said casting surface;

c) a pair of cheek members disposed on either side of said casting drum and defining surfaces sealingly engageable with said side surfaces formed on said casting drum, said cheek members rotatable about a second axis, spaced from said first axis such that said sealing surfaces are in sealing engagement with said casting drum for a predetermined arc of rotation;

d) a casting belt defining a belt casting surface, said belt movable along a path around a portion of said casting drum such that said belt casting surface is located in a confronting but spaced apart relation from said drum casting surface whereby said belt casting surface and said drum casting surface together form a converging casting arc;

e) each cheek member defining a circumferential axial surface engageable with a marginal edge portion of said belt, said peripheral surface moving along an eccentric path relative to said drum casting surface such that said belt is maintained at a changing spaced distance with respect to said drum casting surface when said belt is moving through said casting arc; and, f) means for managing and accommodating ear material formed on a portion of each cheek member as said cheek members rotate through said casting arc.

10. The apparatus of claim 9 having a yoke member pivotally supported about a third axis, said yoke member carrying bearing means to support said cheek members, and carrying casting drum extension means such that longitudinal extension of said drum extension means increases said casting arc without disturbing the confronting but spaced relation of said casting drum and said casting belt.

11. The apparatus of claim 9 wherein each cheek member is annular in configuration and said portion of each cheek member defines a tapered surface extending radially outward from said side surface that narrows in cross section with increasing radial distance whereby a closed recess is defined between said casting drum side and said cheek member that increases in the radial dimension as said cheek member moves through said casting arc.

12. The apparatus of claim 9 further comprising a differential drive means for driving said casting surface defined by said casting drum at a speed different from the surface speed of said casting surface defined by said casting belt.

13. The differential drive means of claim 12 further comprising a plurality of sprockets and a differential mechanism, said sprockets flexibly communicating in driving relationship to drive said casting surface, with at least one of said sprockets being driven by said differential assembly.

14. The differential assembly of claim 13 wherein the assembly is rotatable by an external motor for fine speed adjustments of said casting drum relative to said casting belt.

15. The apparatus of claim 9 further comprising an ear cutting means driven in synchronism with said cheek members for trimming ear material from said continuous strip cast by said apparatus as said strip diverges from a path defined by said casting belt.

16. The apparatus of claim 9 wherein said cheek members each define bearing races engageable with a bearing means for supporting said cheek members for rotation about said second axis.

17. The apparatus of claim 9 further comprising a casting drum support mechanism for biasing said casting drum towards said belt casting surface while allowing said drum to move away from said belt if a counter force greater than said biasing force is encountered.

18. The apparatus of claim 9 wherein said drum side surfaces extend substantially 90° from said drum casting surface.

19. The apparatus of claim 10 wherein the drum extension means is rotatably supported by the yoke, said means being adapted to move the drum to adjust casting arc length while maintaining the spaced relationship between the belt casting surface and the drum casting surface.

20. The apparatus of claim 10 wherein the yoke is comprised of lateral members extending from the third axis to the cheek members, said lateral members supporting longitudinally expandable drum extension means about a fourth axis.

21. The mechanism of claim 20 wherein the lateral members support a casting drum biasing mechanism for biasing said casting drum towards said belt surface while allowing said drum to move away from said belt if a counter force greater than said biasing force is encountered.

22. The mechanism of claim 10 further comprising a yoke rotatable about a third axis, wherein rotation of said yoke about said third axis facilitates repair and replacement of said casting belt.

23. An apparatus for continuously casting strip material, comprising:

a) structure defining two confronting casting surfaces for forming a strip portion of a cast strip in a casting path extending between said casting surfaces;

b) edge constraint means associated with said casting structure for containing a molten pool between said confronting casting surfaces;

c) said edge constraint means cooperating with said casting surface structure to define an enclosed recess that expands to accommodate an ear portion on said strip, formed as said strip is being cast so that said ear portion does not cause interference in the casting path.

24. Apparatus for continuously casting strip material, comprising:

a) structure defining a pair of moving, confronting casting surfaces which together define a converging gap and a path for casting a strip material;

edge constraint means for containing a molten pool in said converging casting gap;

c) said edge constraint means cooperating with said structure to define enclosed recesses at sides of said casting path, said recesses expanding to accommodate the growth of ears as a strip is cast in said casting gap, said ears expanding in size as said strip moves from a casting commencement point in said casting arc to a termination region.

25. The apparatus of claim 24 wherein said structure comprises a drum defining one of said casting surfaces on its periphery, said drum rotating within a ring, said ring defining said other confronting casting surface.

26. The apparatus of claim 24 wherein said structure comprises two confronting belts, each belt defining one of said casting surfaces.

27. The apparatus of claim 24 wherein said structure comprises a pair of rolls disposed in a confronting relationship and rotatable about parallel axes, each of said rolls defining a cylindrical casting surface.

28. The apparatus of claim 24 wherein said edge constraint means comprises a pair of juxtaposed belts disposed at side regions of said casting surfaces.

29. The apparatus of claim 24 wherein said edge constraint means comprises an oscillating cheek member disposed at side regions of said casting surfaces.

30. The apparatus of claim 24 wherein said edge constraint means comprises a belt of cheek blocks abuttably engaging and moving with side regions of said casting surfaces.

31. Apparatus for continuously casting strip material comprising:

a) structure defining a pair of moving, confronting casting surfaces which together define a converging gap and a path for casting a strip material;

b) edge constraint means for containing a molten pool in said converging casting gap;

c) said edge constraint means cooperating with said structure to define enclosed recesses at sides of said casting gap, said recesses expanding to accommodate the growth of ears as a strip is cast in said casting gap, said ears expanding in size as said strip move from a casting commencement point in said casting arc to a termination region;

d) said structure comprising two confronting belts, each belt defining one of said casting surfaces.

32. Apparatus for continuously casting strip material, comprising:

a) structure defining a pair of moving, confronting casting surfaces which together define a converging gap and a path for casting a strip material;

b) edge constraint means for containing a molten pool in said converging casting gap;

c) said edge constraint means cooperating with said structure to define enclosed recesses at sides of said casting path, said recesses expanding to accommodate the growth of ears as a strip is cast in said casting gap, said ears expanding in size as said strip moves from a casting commencement point in said casting arc to a termination region;

d) said structure comprising a pair of rolls disposed in a confronting relationship and rotatable about parallel axes, each of said rolls defining a cylindrical casting surface.

33. Apparatus for continuously casting strip material, comprising:

a) structure defining a pair of moving, confronting casting surfaces which together define a converging gap and a path for casting a strip material;

b) edge constraint means for containing a molten pool in said converging casting gap;

c) said edge constraint means cooperating with said structure to define enclosed recesses at side of said casting path, said recesses expanding to accommodate the growth of ears as a strip is cast in said casting gap, said ears expanding in size as said strip moves from a casting commencement point in said casting arc to a termination region;

d) said edge constraint means comprising-a belt of cheek blocks abuttably engaging and moving with side regions of said casting surfaces.

34. Apparatus for continuously casting strip material, comprising:

a) a casting drum rotatable about a first axis of rotation;

b) a pair of cheek members positioned on either side of a first casting surface defined by said casting drum and rotatable about a second axis, spaced from said first axis;

c) a casting belt reeved around at least a portion of said cheek members and defining a second casting surface spaced from said first casting surface, said belt and casting drum forming a casting arc;

d) each of said cheek members defining a peripheral surface engageable by marginal edges of said belt for maintaining a predetermined spaced distance between said casting surfaces and an inner sealing surface engageable with a side surface defined by said casting drum for a predetermined arc of rotation of said drum; and, e) said eccentric mounting of said cheek members with respect to said casting drum causing said spacing between said drum casting surface and said belt casting surface to decrease as an end of said casting arc is reached such that a converging casting arc is defined;

f) each cheek member defining a surface tapering in the radial direction such that in said casting arc, a recess is defined between a portion of each cheek member and a portion of said casting drum that increases in the radial direction as the end of the casting arc is approached so that an expanding recess is provided for receiving ear material during a casting operation.

35. Apparatus for continuously casting strip material such as strip steel, comprising:

a) a casting drum defining a casting surface having a radius of rotation about a first axis;

b) said casting drum defining side surfaces extending from opposite sides of said casting surface;

c) a pair of cheek members disposed on either side of said casting drum and defining surfaces sealingly engageable with said side surfaces formed on said casting drum, said cheek members rotatable about a second axis, spaced from said first axis such that said sealing surfaces are in sealing engagement with said casting drum for a predetermined arc of rotation;

d) a casting belt defining a belt casting surface, said belt movable along a path around a portion of said casting drum such that said belt casting surface is located in a confronting but spaced apart relation from said drum casting surface whereby said belt casting surface and said drum casting surface together form a converging casting arc; and, e) each cheek member defining a circumferential, axial surface engageable with a marginal edge portion of said belt, said circumferential, axial surface moving along an eccentric path relative to said drum casting surface such that said belt is maintained at a changing spaced distance with respect to said drum casting surface when said belt is moving through said casting arc;

f) each cheek member being annular in configuration and defining a tapered surface extending radially outward from said side surface that narrows in cross section with increasing radial distance whereby a closed recess is defined between said casting drum side and said cheek member that increases in the radial dimension as said cheek member moves through said casting arc.

36. The apparatus of claim 35 wherein one of said rolls is rotatably supported by extension means to adjust said casting arc length while preserving said confronting but spaced apart relationship of said rolls, said means being rotatably supported about a fourth axis by a yoke member supported for rotation about a third axis, said yoke carrying bearing means for rotatable support of said edge constraint means.

37. The apparatus of claim 36 wherein the drum extension means comprises a casting surface support mechanism, said mechanism carrying bearing means to rotatably support said casting surface, and a casting surface extension mechanism to increase or decrease the radial distance between said fourth axis and said casting surface support mechanism.

38. The apparatus of claim 36 wherein a spring biasing mechanism biases said casting surface support mechanism toward said casting path while allowing one of said casting surfaces to move away from said path if a counter force greater than said biasing force is encountered.

39. The apparatus claim 36 wherein the extension means comprises a pair of alternately threaded rods, said rods having miter gear heads in rotational relationship with a corresponding miter gear attached to a drive shaft, said shaft having a sprocket rotatively driven by an external power source in driving relationship with said sprocket, whereby rotation of said head shaft longitudinally expands or contracts casting surfaces to modify said casting arc length without disturbing the confronting but spaced relation of said casting surfaces.

* * * * *